US009421144B2

(12) United States Patent
Kalinowski

(10) Patent No.: US 9,421,144 B2
(45) Date of Patent: Aug. 23, 2016

(54) MOTORIZED AIR WALKER AND SUSPENSION SYSTEM FOR PARALYZED PERSONS

(71) Applicant: Eugene Kalinowski, Westhampton, NY (US)

(72) Inventor: Eugene Kalinowski, Westhampton, NY (US)

( * ) Notice: Subject to any disclaimer, the term of this patent is extended or adjusted under 35 U.S.C. 154(b) by 0 days.

(21) Appl. No.: 14/639,247

(22) Filed: Mar. 5, 2015

(65) Prior Publication Data

US 2015/0250675 A1 Sep. 10, 2015

Related U.S. Application Data

(60) Provisional application No. 61/967,016, filed on Mar. 7, 2014.

(51) Int. Cl.
*A61H 3/00* (2006.01)
*A61H 1/02* (2006.01)

(52) U.S. Cl.
CPC ..... *A61H 3/008* (2013.01); *A63B 21/4007* (2015.10); *A61H 1/0237* (2013.01); *A61H 1/0274* (2013.01); *A61H 2001/0211* (2013.01); *A61H 2003/007* (2013.01)

(58) Field of Classification Search
CPC ... A61H 3/00; A61H 3/008; A61H 2003/002; A61H 2003/007; A61H 1/00; A61H 1/0237; A61H 1/0262; A61H 2001/0211; A63B 21/4003; A63B 21/4007; A63B 21/4009; A63B 21/4011; A63B 21/4017; A63B 26/003; A61G 7/005; A61G 7/10; A61G 7/1013; A61G 7/1015
See application file for complete search history.

(56) References Cited

U.S. PATENT DOCUMENTS

| | | | |
|---|---|---|---|
| 3,823,712 | A | 7/1974 | Morel |
| 3,872,945 | A | 3/1975 | Hickman et al. |
| 4,986,261 | A | 1/1991 | Iams et al. |
| 5,054,476 | A | 10/1991 | Petrofsky et al. |
| 5,406,658 | A | 4/1995 | Olkkonen et al. |
| 5,459,891 | A | 10/1995 | Reeve et al. |
| 6,162,151 | A | 12/2000 | Tani et al. |

(Continued)

FOREIGN PATENT DOCUMENTS

| | | | |
|---|---|---|---|
| WO | 03105744 | A3 | 4/2004 |
| WO | 2012008664 | A1 | 1/2012 |
| WO | 2014078667 | A1 | 5/2014 |

OTHER PUBLICATIONS

PCT International Search Report and Written Opinion of PCT/US2015/018852 mailed Jun. 8, 2015; 12 pp.

*Primary Examiner* — Quang D Thanh
(74) *Attorney, Agent, or Firm* — Carter, Deluca, Farrell & Schmidt, LLP

(57) ABSTRACT

A system for patient rehabilitation is disclosed. The system includes a first movable frame including an articulating bed, wherein the bed is configured to be selectively articulated to an inclined position, a suspension system, wherein the suspension system is disposed within the articulating bed and is selectively adjustable to accommodate varying patient height, a harness, wherein the harness is selectively engageable with the suspension system, wherein the harness is selectively adjustable to accommodate varying patient sizes, a second movable frame including a walker, wherein the walker includes a pair of legs and a motor, wherein approximation of the two movable frames permits the patient to easily utilize the walker from the bed. A method of using the system for patient rehabilitation is also disclosed.

19 Claims, 31 Drawing Sheets

(56) References Cited

U.S. PATENT DOCUMENTS

| | | | | |
|---|---|---|---|---|
| 6,666,798 | B2 | 12/2003 | Borsheim | |
| 6,685,658 | B1 * | 2/2004 | Dietz | A61H 1/0229 128/845 |
| 6,821,233 | B1 | 11/2004 | Colombo et al. | |
| 7,011,605 | B2 | 3/2006 | Shields | |
| 7,137,959 | B2 * | 11/2006 | Phillips | A61H 1/0255 482/51 |
| 7,163,492 | B1 * | 1/2007 | Sotiriades | A61H 1/0237 482/51 |
| 7,699,140 | B2 | 4/2010 | Beggrow et al. | |
| 7,793,950 | B2 | 9/2010 | Van Eeden | |
| 8,613,691 | B2 | 12/2013 | Bosecker et al. | |
| 2002/0011714 | A1 | 1/2002 | Kurashige | |
| 2006/0206167 | A1 | 9/2006 | Flaherty et al. | |
| 2007/0016116 | A1 | 1/2007 | Reinkensmeyer et al. | |
| 2007/0037667 | A1 | 2/2007 | Gordon | |
| 2009/0036009 | A1 | 2/2009 | Carl | |
| 2011/0083266 | A1 | 4/2011 | Herron | |
| 2011/0166487 | A1 | 7/2011 | Fullenkamp | |
| 2011/0166488 | A1 | 7/2011 | Miyake | |
| 2012/0090089 | A1 | 4/2012 | Stryker et al. | |
| 2012/0209152 | A1 | 8/2012 | Cordo | |
| 2013/0137553 | A1 | 5/2013 | Kim et al. | |
| 2013/0150980 | A1 | 6/2013 | Swift et al. | |
| 2013/0211295 | A1 | 8/2013 | Johnson et al. | |
| 2015/0141209 | A1 * | 5/2015 | Chen | A63B 22/0664 482/52 |

* cited by examiner

MOTORIZED AIR WALKER AND SUSPENSION SYSTEM FOR PARALYZED PERSONS

CROSS-REFERENCE TO RELATED APPLICATION

This application claims priority to, and the benefit of, U.S. Provisional Patent Application No. 61/967,016, filed on Mar. 7, 2014, the entire contents of which are hereby incorporated by reference herein.

BACKGROUND

1. Technical Field

The present disclosure relates generally to apparatus and methods for gait rehabilitation and, in particular, to an apparatus for locomotor therapy and method of operating the same.

2. Background of the Disclosure

Spinal cord injuries affect approximately 12,000 individuals within the United States each year. Such injuries, as well neurological disorders, can have a devastating effect on the lives of those suffering from such an affliction, especially those who are young. Recent innovations in the area of gait rehabilitation have explored the use of locomotor therapy for those suffering from stroke, spinal cord injury, Parkinson's disease, cerebral palsy, traumatic brain injury, and the like. Using locomotor therapy, an individual can retrain the brain, through repetitive practice of complex gait stroke, to re-learn the motor skills required to effectuate locomotion.

Many locomotor therapy machines utilize body weight support systems to maintain the patient's position relative to a device for effectuating movement of the limbs. This is accomplished by supporting the patient through use of a body harness and a gantry placed over the ground or more often a treadmill. While this sufficiently unloads the patient's legs and maintains the body position of the patient, significant effort is required by the clinician to guide the patient into the harness and into an appropriate position within the machine. Additionally, the clinician is often required to manually effectuate movement of the patient's limbs until the patient has reached a stage where sufficient locomotive ability is gained to operate the system on their own.

One example of a system as described in the foregoing is disclosed in U.S. Pat. No. 6,666,798. The disclosed locomotor therapy system is of the body support system treadmill training type and utilizes a gantry and harness to support the patient over a treadmill. The system requires the aid to be positioned either behind or in front of the patient, with the clinician's legs being coupled to the patient's legs by a series of brackets. Through this system, the clinician's gait is duplicated by the patient, thereby effectuating locomotion.

This type of system often places considerable strain on the therapist. Additionally, it is difficult to maintain consistent gait as locomotion is effectuated manually by the clinician. An additional limitation is the gait of the clinician is often mismatched with that of the patient due to differing body sizes.

In order to mitigate some of these issues, driven gait orthosis have been developed to robotically control the patient's gait as the patient walks on the treadmill. These devices utilize the body weight support systems as described above, with the addition of the driven gait orthosis being secured to the patient's legs. This system removes the need for the clinician to manually effectuate locomotion in addition to providing consistent gait.

One example of a driven gait orthosis system is disclosed in U.S. Pat. No. 6,821,233. The disclosed driven gait orthosis system utilizes a body support system and a treadmill consistent with the previous disclosure. However, replacing the clinician is a driven and controlled orthotic device, which guides the legs in a physiological pattern of movement. Additionally, the orthotic device can be adjusted and adapted to different patients.

While this type of system eliminates some of the previously disclosed issues, significant limitations still remain. There remains the issue of guiding and lifting the patient into the correct position in order to effectively use the system. Additionally, significant effort is required to secure and adjust the driven gait orthosis to the patient. Moreover, a limitation of both disclosed systems is the patient being a passive part of the system, i.e. effectuation of the movement of the legs is by means of external forces.

It would be preferable, however, if the clinician had the ability to allow the patient to effectuate their own locomotion, the ability to easily transfer the patient to and from the locomotor therapy system, the ability to easily adapt the system to each patient's physiological makeup, and the ability to rehabilitate paraplegic and quadriplegic patients without transferring the patient to separate machines. As such, there remains a need for an improved locomotor therapy system.

SUMMARY

The present disclosure relates to patient rehabilitation.

According to an aspect of the present disclosure, a system for patient rehabilitation is provided and includes an articulating bed, a walker, and a harness.

The articulating bed includes a first movable frame, a bed, and a suspension system. The bed includes a first and second end, wherein the bed is rotatably supported by the first movable frame at a first end. The bed is configured to be selectively articulated to an inclined position. The suspension system is disposed within the bed and includes a frame including proximal and distal ends. The frame is translatably supported by the bed and includes an arm extending from the proximal end thereof. The arm is configured to support a harness and the suspension system is selectively adjustable along a longitudinal axis defined by the first and second ends of the bed.

The walker includes a second movable frame, a pair of legs and a reciprocator. The pair of legs includes an upper and lower end, wherein each of the pair of legs is rotatably supported by the second movable frame. Each of the pair of legs includes a foot support on the lower end thereof and a gripping portion for a patient's hand on the upper end thereof.

The reciprocator includes a motor, a flywheel frame, and a flywheel rotatably supported by the flywheel frame. The motor is rigidly secured to the second movable frame and includes a sprocket that is in mechanical cooperation with the motor. The flywheel frame is rigidly secured to the second movable frame. The flywheel is in operative communication with the sprocket and at least one of the pair of legs.

The harness includes a plurality of straps for securing the torso, legs, head, hand, arms, and feet of a patient. The plurality of straps are selectively engageable with the suspension system of the articulating bed and are selectively adjustable to accommodate a variety of patient sizes.

The articulating bed may include an actuator for articulation.

The actuator may be selected from the group consisting of a hydraulic actuator, a pneumatic actuator, and an electric actuator.

The foot support may be adjustable to accommodate a variety of patient sizes.

The second movable frame may include a knee support disposed on each of the pair of legs. The knee support may be configured to support the patient's knee and may be adjustable to accommodate a variety of patient sizes.

The frame of the suspension system may be translated by an actuator. The actuator may be selected from the group consisting of a hydraulic actuator, a pneumatic actuator, and an electric actuator.

The reciprocator may include a pair of adjustment bars that are rigidly secured to a first side and a second side of the flywheel. A pair of adjustment bars may radially extend from a center point of the flywheel in opposing directions and may include a plurality of holes defined therethrough extending along a longitudinal axis of each of the pairs of adjustment bars.

The system may further include a pair of pivot blocks configured and dimensioned to advance over each of the pair of adjustment bars. The pivot blocks may be selectively engageable with one of the plurality of holes of the adjustment bars. Each of the pair of pivot blocks may include an axle extending normally therefrom.

The system may further include a pair of control members having proximal and distal ends. The proximal end of each of the pair of control members may be rotatably supported by one of the pair of legs of the walker. The distal end of the pair of control members may be rotatably supported by the axle of the pivot block.

The height of the gripping portion of the pair of legs may be selectively adjustable.

The motor may include a speed reduction gearbox.

The system may further include a drive transmitting device to transmit the rotation of the sprocket to the flywheel.

The drive transmitting device may be a chain or a belt.

According to a further aspect of the present disclosure, a system for patient rehabilitation is provided. The system includes an articulating bed having a first movable frame; a bed including a first and second end, wherein the bed is rotatably supported by the first movable frame at a first end, wherein the bed is configured to be selectively articulated to an inclined position; and a suspension system. The suspension system is disposed within the bed. The suspension system includes a frame including proximal and distal ends. The frame is translatably supported by the bed, and includes an arm extending from the first end of the bed. The suspension system is selectively adjustable along a longitudinal axis between the first and second ends of the bed.

The system may further include a walker including a second movable frame; a pair of legs including an upper and lower end, wherein each of the pair of legs is rotatably supported by the second movable frame, wherein each of the pair of legs includes a foot support on the lower end thereof, wherein each of the pair of legs includes a gripping portion for a patient's hand on the upper end thereof.

The walker further includes a reciprocator including a motor, wherein the motor is rigidly secured to the second movable frame, wherein the motor includes a sprocket, wherein the sprocket is in mechanical cooperation with the motor; a flywheel frame, wherein the flywheel frame is rigidly secured to the second movable frame; and a flywheel rotatably supported by the flywheel frame, wherein the flywheel is in operative communication with the sprocket, wherein the flywheel is in operative communication with at least one of the pair of legs.

The system may further include a harness, including a plurality of straps for securing the torso, legs, head, hands, arms, and feet of a patient, wherein the plurality of straps are selectively engageable with the suspension system of the articulating bed, wherein the straps are selectively adjustable to accommodate a variety of patient sizes.

The bed may define a plane, wherein the bed is articulatable from a first orientation wherein the plane of the bed is parallel to a floor supporting the system, and second inclined orientation angled with respect to the first orientation.

The second inclined orientation may be orthogonal to the first orientation.

The suspension system may include a harness supported by the arm.

According to another aspect of the present disclosure, a method for patient rehabilitation is provided and includes providing an articulating bed, a walker, and a harness.

The articulating bed includes a first movable frame, a bed, and a suspension system for supporting a harness. The bed may be selectively articulated to an inclined position. The suspension system may be selectively adjustable to accommodate varying patient sizes.

The walker includes a second movable frame, a pair of legs, and a reciprocator. Each of the pair of legs includes a foot support on a bottom end thereof. Each of the pair of legs further includes a gripping portion for a patient's hand on an upper end thereof.

The harness is selectively engageable with the suspension system and is selectively adjustable to accommodate a variety of patient sizes.

The method further includes lying a patient down on the articulating bed, securing the harness around the torso, legs, and head of the patient, adjusting the height of the suspension system to accommodate the size of the patient, securing the harness to the suspension system, approximating the first movable frame and the second movable frame, articulating the articulating bed to an inclined position, and adjusting the suspension system to accommodate the size of the patient such that the patient may utilize the walker.

The reciprocator may further include a pair of adjustment bars, a pair of pivot blocks, and a pair of control members. Adjustment of the pivot blocks may cause a stroke of the walker to increase or decrease in order to accommodate a gait of the patient.

The gripping portion of each of the pair of legs may be selectively adjustable in height. Selective adjustment of the height of the gripping portion of each of the pair of legs may increase or decrease the stroke of the pair of legs of the walker in order to accommodate a gait of the patient.

The method may further include adjusting the foot support to accommodate the size of the patient.

The second movable frame may include a knee support disposed on each of the pair of legs. The knee support may be configured to support the patient's knee and may be adjustable to accommodate the size of the patient.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE EMBODIMENTS

Figure 1:
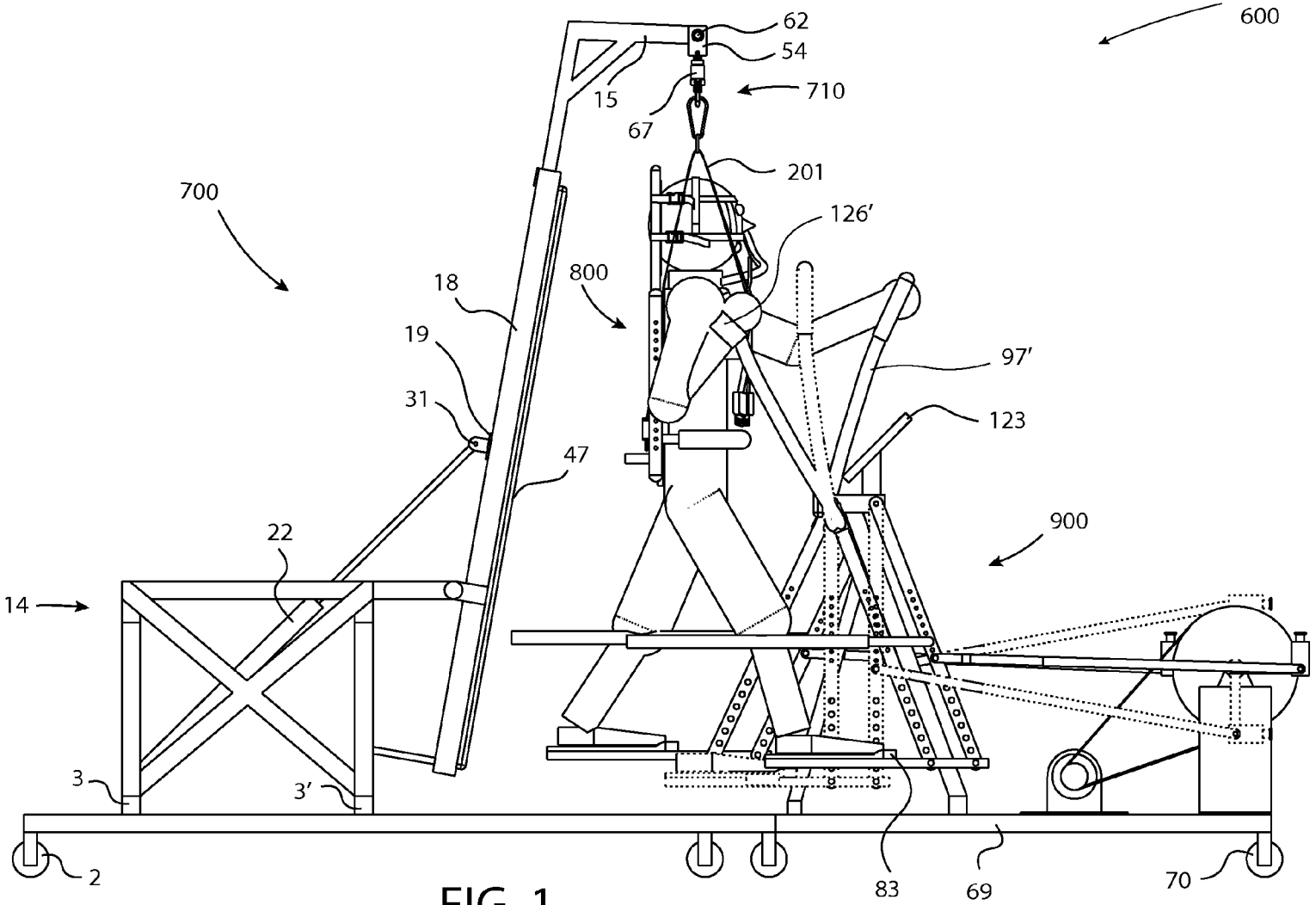
FIG. 1 is an elevation view of a patient rehabilitation system according to an embodiment of the present disclosure.

Embodiments of the present disclosure are now described in detail with reference to the drawings in which like reference numerals designate identical or corresponding elements in each of the several views. As used herein, the term "clinician" refers to a doctor, a nurse or any other care provider and may include support personnel. Additionally, the term "person" refers to a patient. The term "proximal" will refer to the portion of the device, component, or patient thereof that is closer to the clinician and the term "distal" will refer to the portion of the device, component, or patient thereof that is farther from the clinician. The term "cephalic" will refer to the portion of the device, component, or portion of the body of a patient that is towards the head of the patient and the term "caudal" will refer to the portion of the device, component, or portion of the body of a patient that is towards the feet of the patient. Additionally, in the drawings and in the description that follows, terms such as front, rear, upper, lower, top, bottom, and similar directional terms are used simply for convenience of description and are not intended to limit the disclosure. In the following description, well-known functions or constructions are not described in detail to avoid obscuring the present disclosure in unnecessary detail.

Figure 2:
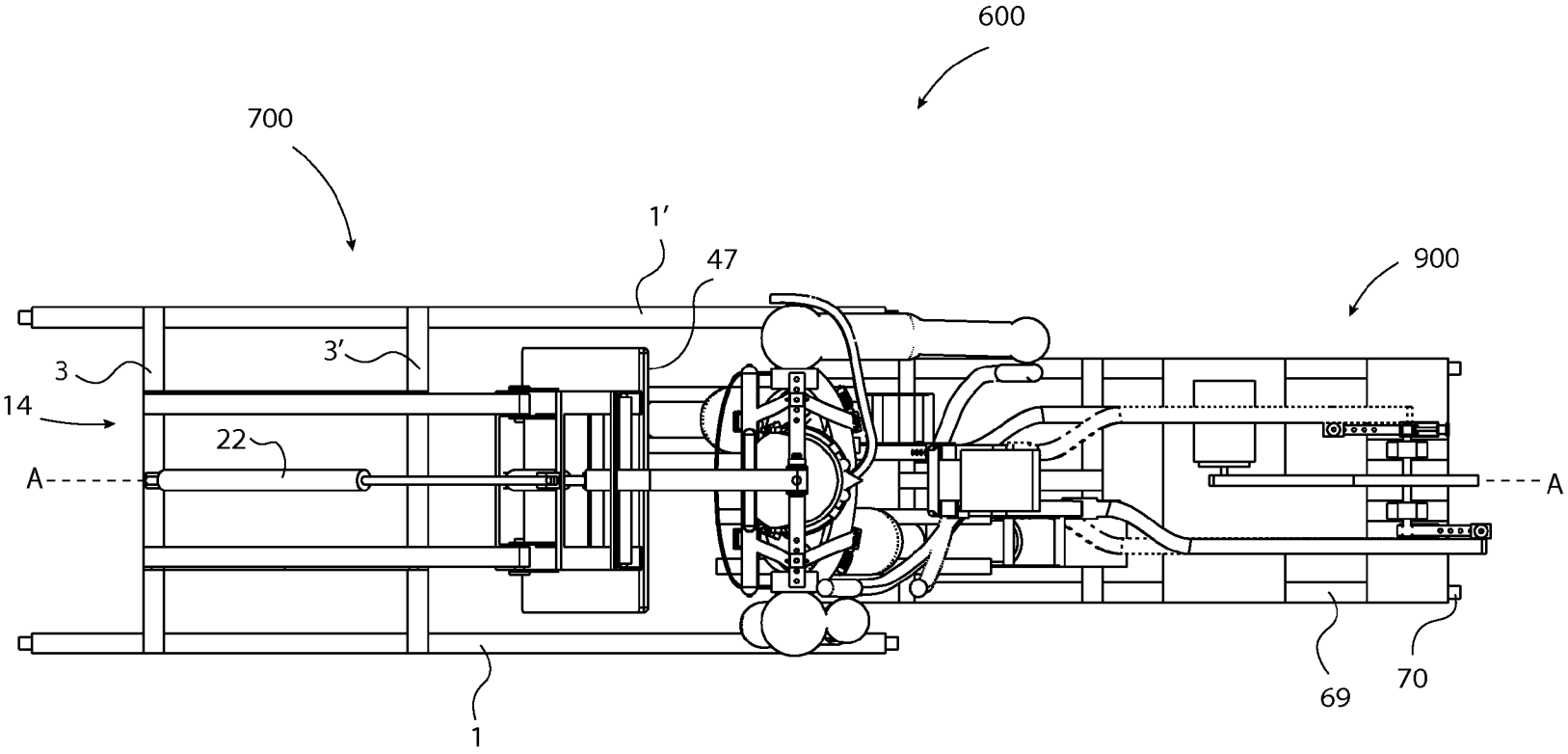
FIG. 2 is a plan view of the patient rehabilitation system of FIG. 1.

As an initial matter, some elements are symmetric about the center of the machine 600 as viewed from above (i.e. plan view). With reference to FIG. 2, the center of the machine 600 defines an axis "A" bisecting horizontal base member 3 of frame 14 of bed lifter 700 and extending horizontally through motorized air walker 900. Axis "A" thereby bisects the machine 600 into left and right halves. As will be discussed in further detail below, each module (bed lifter 700, motorized air walker 900, and harness 800) is similarly bisected by a respective axis, such that the respective axes are co-axial when each module is oriented in their final positions.

Referring now to the drawings, the machine 600, according to the present disclosure, includes three modules. Module one, the "bed-lifter" 700, is presented within FIGS. 3, 4, 4A, 5, and 6. Module two, "the motorized air walker" 900, is illustrated within FIGS. 7-14. Module three, "the harness" 800, is illustrated within FIGS. 15-20A. While the following description relates to the use of the "bed-lifter" 700 in cooperation with "the motorized air walker" 900, it is contemplated and within the scope of the present disclosure that the "bed-lifter" 700 may be used independently of "the motorized air walker" 900, may be used as a standalone system (wherein the patient walks along the floor and pulls the "bed-lifter" 700 along the floor), or may be used in cooperation with other rehabilitation systems, such as, for example, a treadmill, a cross-country skiing system, an exercise bicycle, an elliptical machine or the like. It is envisioned that the use of the "bed-lifter" 700 may be in any situation that a person will benefit from being in a vertical position while exercising or rehabilitating, wherein the body of the person is supported.

Figure 1A:
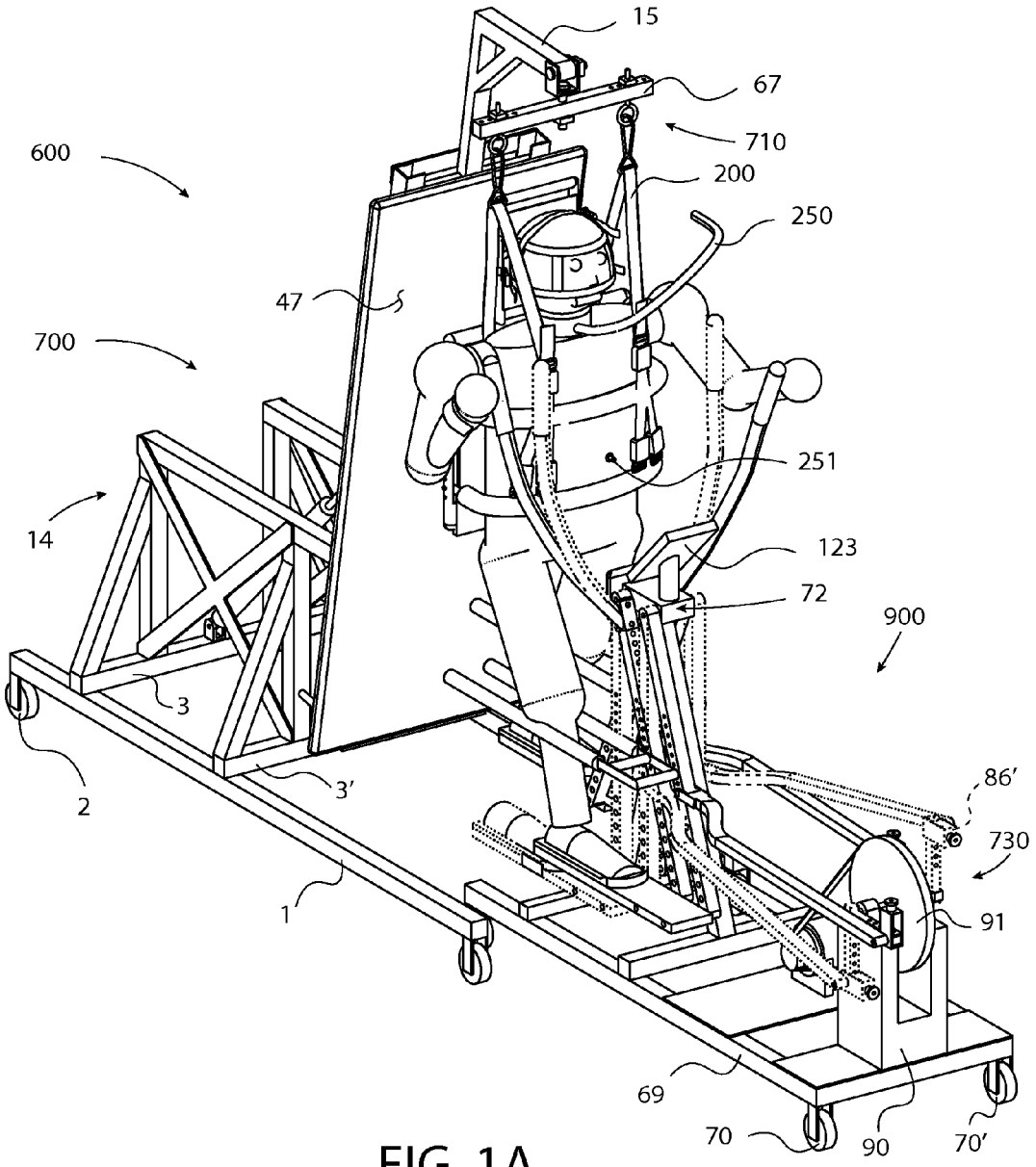
FIG. 1A is a perspective view of the patient rehabilitation system of FIG. 1.

FIGS. 1, 1A, and 2 illustrate the overall external appearance of the bed-lifter 700 including frame 14, which includes casters 2 disposed on the underside thereof, and a schematic of motorized air walker 900, including walker frame 69, which includes casters 70, 71. Casters 70, 71 include a braking mechanism, wherein the braking mechanism may be any means known in the art to effectuate braking or inhibit movement of the walker frame 69. The casters 2, which may include a brake, are widely available on the market and permit the bed-lifter 700 to move as needed as will be disclosed herein.

Figure 3:
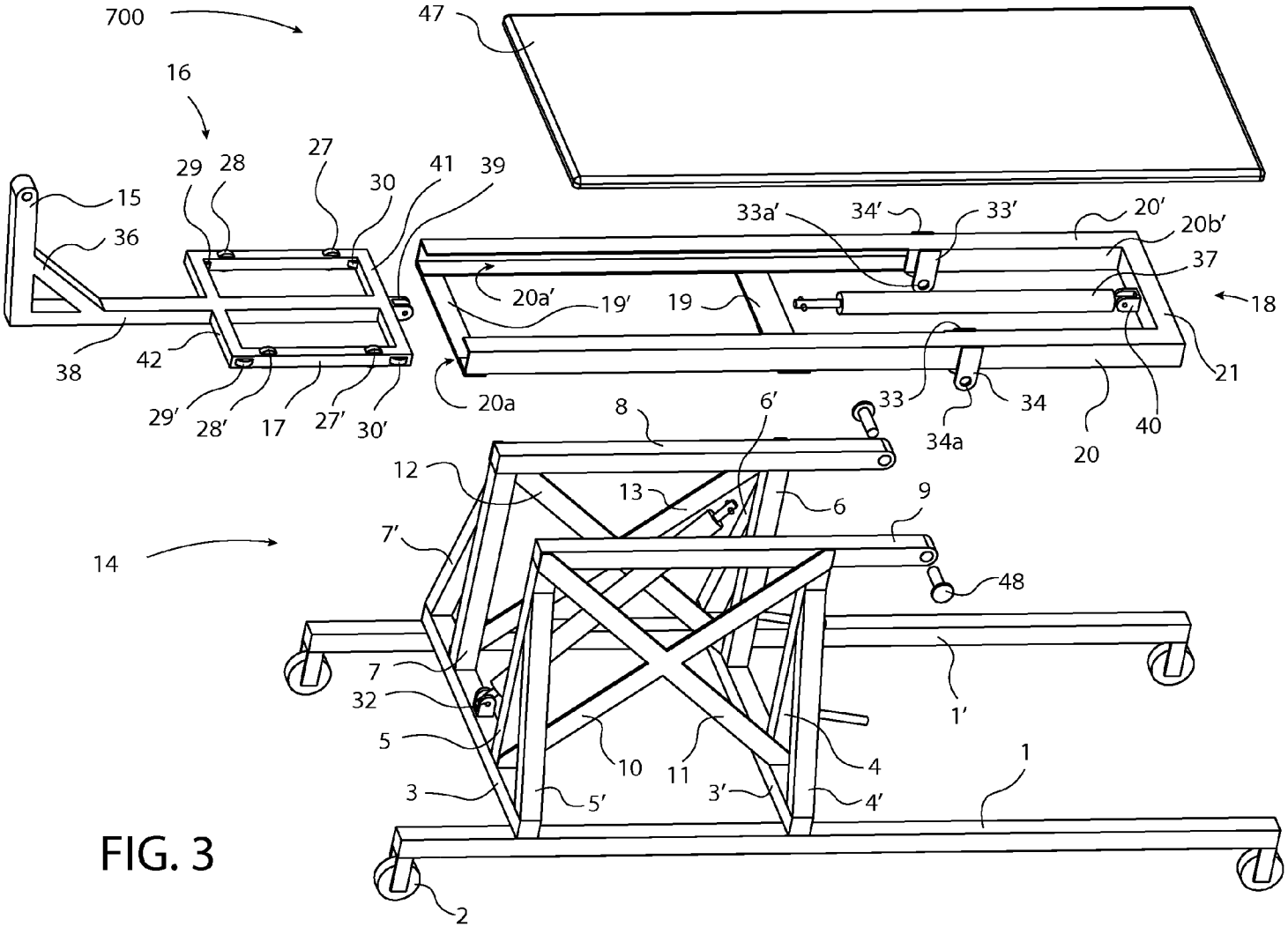
FIG. 3 is a side, perspective view, with parts separated, of a bed lifter of the patient rehabilitation system of FIG. 1.
Figure 4:
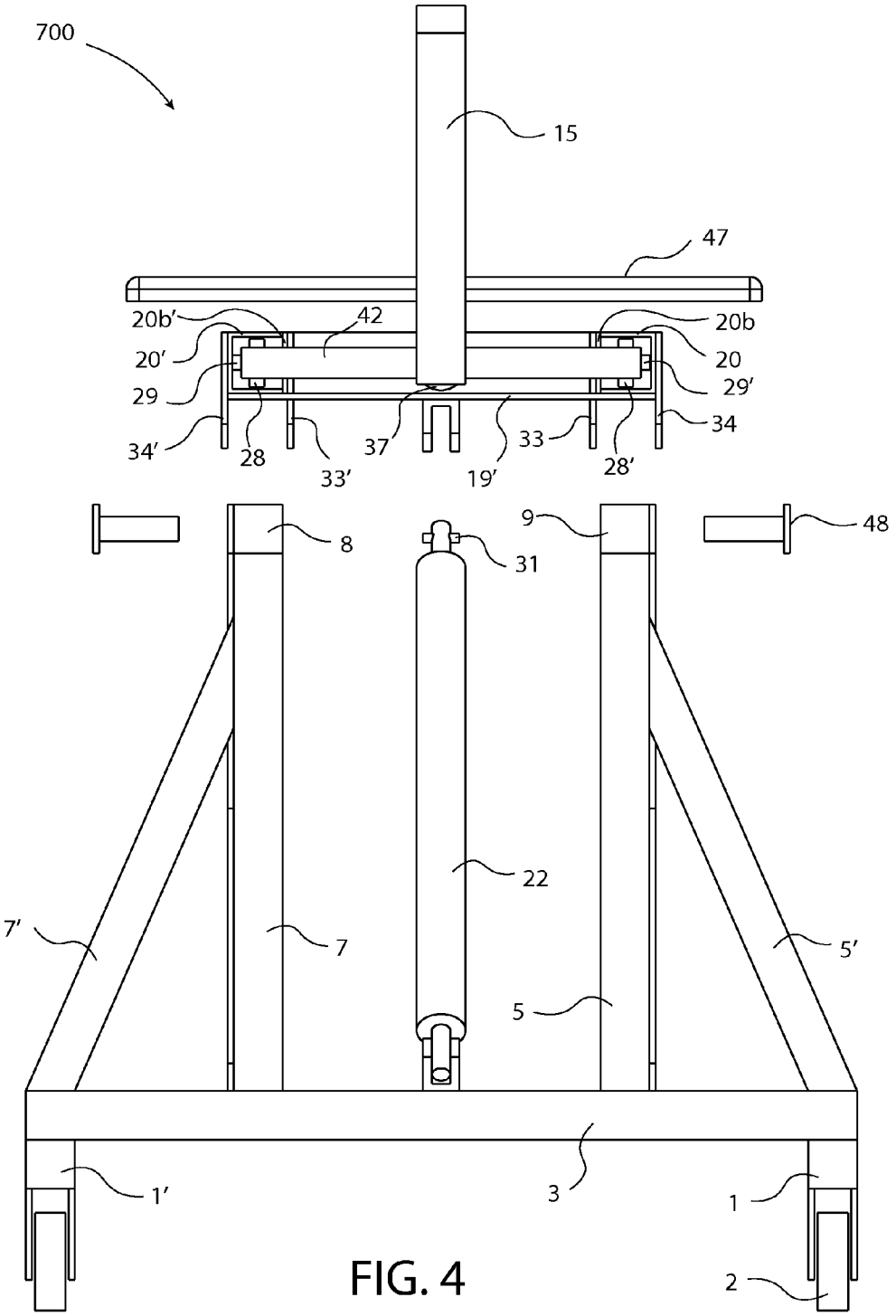
FIG. 4 is a side view, with parts separated, of the bed lifter of FIG. 3.

Referring now to FIGS. 3 and 4, the frame 14 of bed-lifter 700 includes horizontal base members 1 and 1', which are rigidly connected with horizontal base members 3 and 3'. Extending vertically from horizontal base member 3' are vertical support members 4 and 6, which are rigidly connected thereto. Extending vertically from horizontal base member 3 are vertical support members 5 and 7, which are rigidly connected thereto. Bed frame support 8, extending parallel to horizontal base member 1', is rigidly connected to vertical support members 6 and 7, whereas bed frame support 9, extending parallel to horizontal base member 1, is rigidly connected to vertical support members 4 and 5. Diagonal support members 10 and 11 are rigidly connected to vertical support members 4 and 5 and are configured to provide frame 14 with stability along axis "A". Similarly, diagonal support members 12 and 13 are rigidly connected to vertical support members 6 and 7 and are configured to provide frame 14 with stability along axis "A". Diagonal support members 10 and 11, and diagonal support members 12 and 13 may be configured such that diagonal support member 10 and 11, and 12 and 13, respectively, intersect. Providing transverse stability (i.e. stability normal to axis "A") to frame 14 are truss members 4', 5', 6', and 7'. Truss members 5' and 7' are rigidly connected to, and extend vertically from, horizontal base member 3, and truss members 4' and 6' are rigidly connected to, and extend vertically from, horizontal base member 3' such that truss members 4', 5', 6', and 7' form an acute angle with respect to vertical support members 4, 5, 6, and 7, respectively. Additionally, truss members 4', 5', 6', and 7' are rigidly secured at an upper end to respective vertical support members 4, 5, 6, and 7. In order to facilitate easy maneuverability of frame 14, casters 2 may be swiveling and may include a braking mechanism as discussed in the foregoing. In one embodiment, frame 14 includes four casters 2.

Referring back to FIG. 1, an embodiment of bed frame 18 is illustrated as being in an inclined position. Pivot 31 is rigidly secured to a stiffening member 19 which is rigidly secured to an underside of bed frame 18 and pivot 32 is rigidly connected to horizontal base member 3 (FIG. 3). Telescoping actuator 22 is interposed between horizontal base member 3 and the stiffening member 19 of bed frame 18 and is mechanically secured thereto by pivots 31, 32. Telescoping actuator 22 may be any telescoping actuator capable of effectuating linear movement, such as pneumatic, hydraulic, electric, push/pull, or the like.

As illustrated in FIGS. 3 and 4, bed frame 18 includes horizontal beams 20 and 20'. In one embodiment, horizontal beams 20 and 20' include a C-shape profile 20*a* and 20*a'*, although other suitable profiles are contemplated. Bed frame 18 also includes stiffening member 19' extending normal to horizontal beams 20 and 20' and being rigidly connected thereto. Transverse support 21 is interposed between horizontal beams 20 and 20' and is rigidly connected thereto thereby forming the three sides of bed frame 18. Horizontal beams 20 and 20' include closeout plates 20*b* and 20*b'* rigidly secured thereto and immediately adjacent to transverse support 21. Lugs 33 and 34 include through-holes 33*a* and 34*a* (FIGS. 3, 4A) and are rigidly connected to horizontal beam 20 and closeout plate 20*b*. Lugs 33 and 34 are positioned such that horizontal beam 20 and closeout plate 20*b* are interposed between lugs 33 and 34. Similarly, lugs 33' and 34' include through-holes 33*a'* and 34*a'* and are rigidly connected to horizontal beam 20' and closeout plate 20*b'*. Similarly to lugs 33 and 34, lugs 33' and 34' are positioned such that horizontal beam 20' and closeout plate 20*b'* are interposed between lugs 33' and 34'. Frame 18 serves as a housing for wagon 16 as illustrated in FIGS. 1, 3, and 4.

Figure 4A:
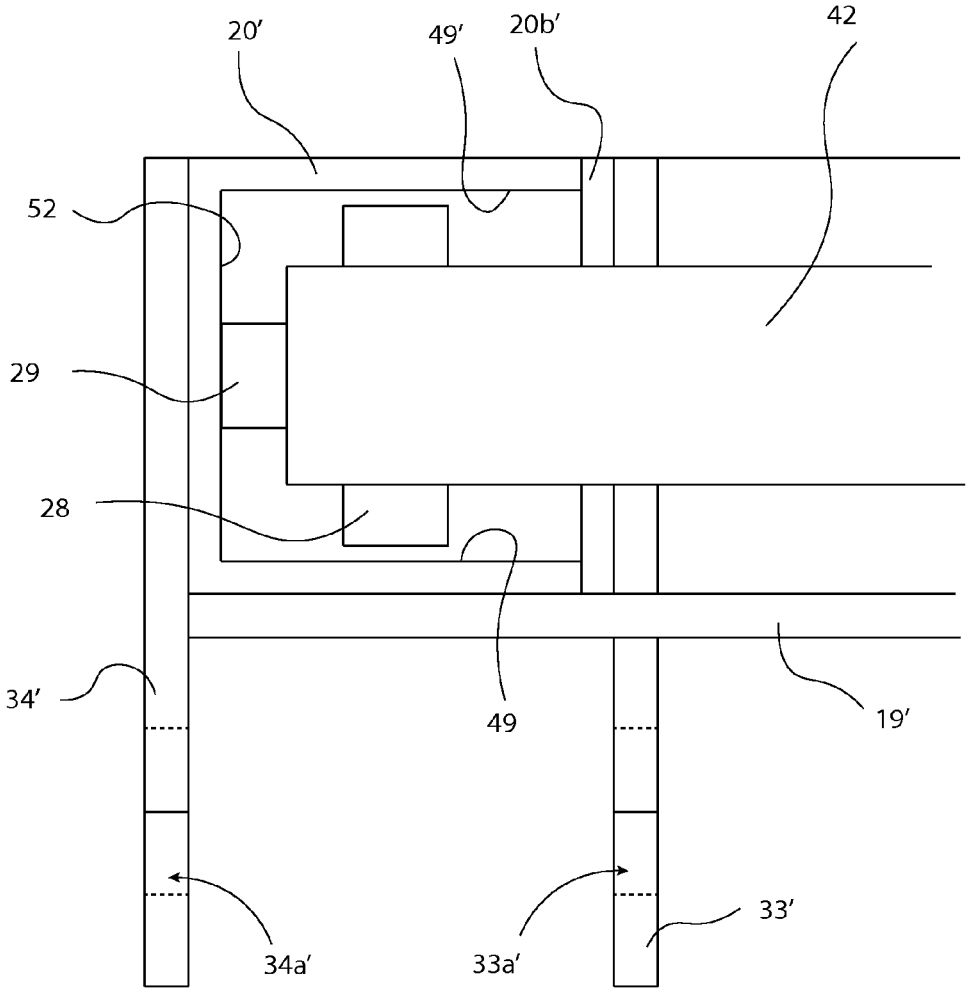
FIG. 4A is an enlarged view of the area of detail of FIG. 4.

Continuing with FIGS. 3 and 4, an embodiment of wagon 16 is illustrated. Wagon 16 includes a plurality of wheels 27, 28, 29, 30, 27', 28', 29' and 30' that enable wagon 16, when disposed within the C-shaped profile 20*a* and 20*a'* of horizontal beams 20 and 20', to translate along axis "A". As illustrated in FIGS. 4 and 4A, horizontal wheel 29 acts against surface 52 inside horizontal beam 20' while vertical wheel 28 acts against surfaces 49 and 49'. Similar to the foregoing, each corner of wagon 16 may include a horizontal wheel 29', 30, or 30', and a vertical wheel 27, 27', or 28'. Each of wheel 27, 27', 28, 28', 29, 29', 30, and 30' acts upon a respective surface within C-shaped channels 20*a* and 20*a'* of horizontal beams 20 and 20' respectively. Each of wheels 27, 27', 28, 28', 29, 29', 30, and 30' permits wagon 16 to translate along axis "A" while loaded thereby allowing adjustment of the height of an arm 15 of wagon 16 with the use of actuator 37 (FIG. 3), as will be discussed in detail below.

It is contemplated that the C-shaped channels and plurality of wheels may be replaced by a plurality of rods and linear bearings, or the like.

Figure 6A:
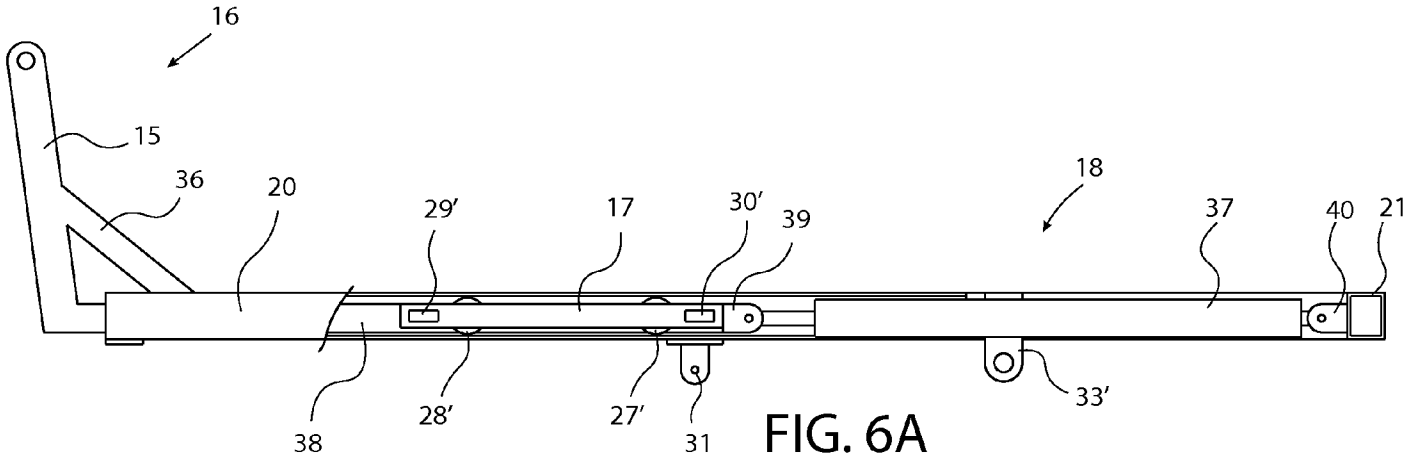
FIG. 6A is a side, partial cutaway view of a wagon of the bed lifter of FIG. 3.
Figure 6B:
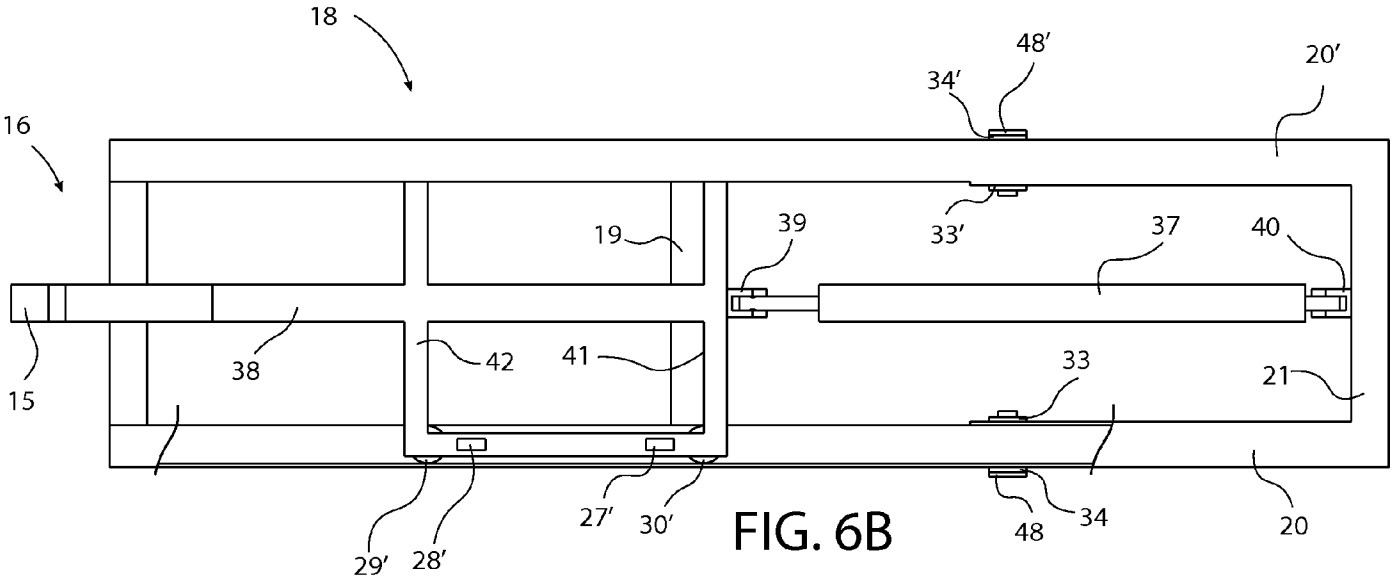
FIG. 6B is a plan view of the wagon of FIG. 6A.

As best illustrated in FIGS. 3, 6A, and 6B, wagon 16 includes rigidly mounted extension 38. An end of extension 38 includes arm 15, extending vertically therefrom. Support 36 is rigidly connected to extension 38 and arm 15 such that support 36 acts as a gusset. Actuator 37 is interposed between wagon 16 and bed frame 18 and may effectuate movement of wagon 16 along axis "A" with respect to bed frame 18. Actuator 37 may be any actuator capable of effectuating linear movement, such as pneumatic, hydraulic, electric, or the like. Actuator 37 is mechanically secured to wagon 16 by lug 39 and mechanically secured to bed frame 18 by lug 40. Lug 39 is rigidly connected to wagon 16 and lug 40 is rigidly connected to transverse support 21 of bed frame 18 best illustrated in FIG. 6B.

Figure 5:
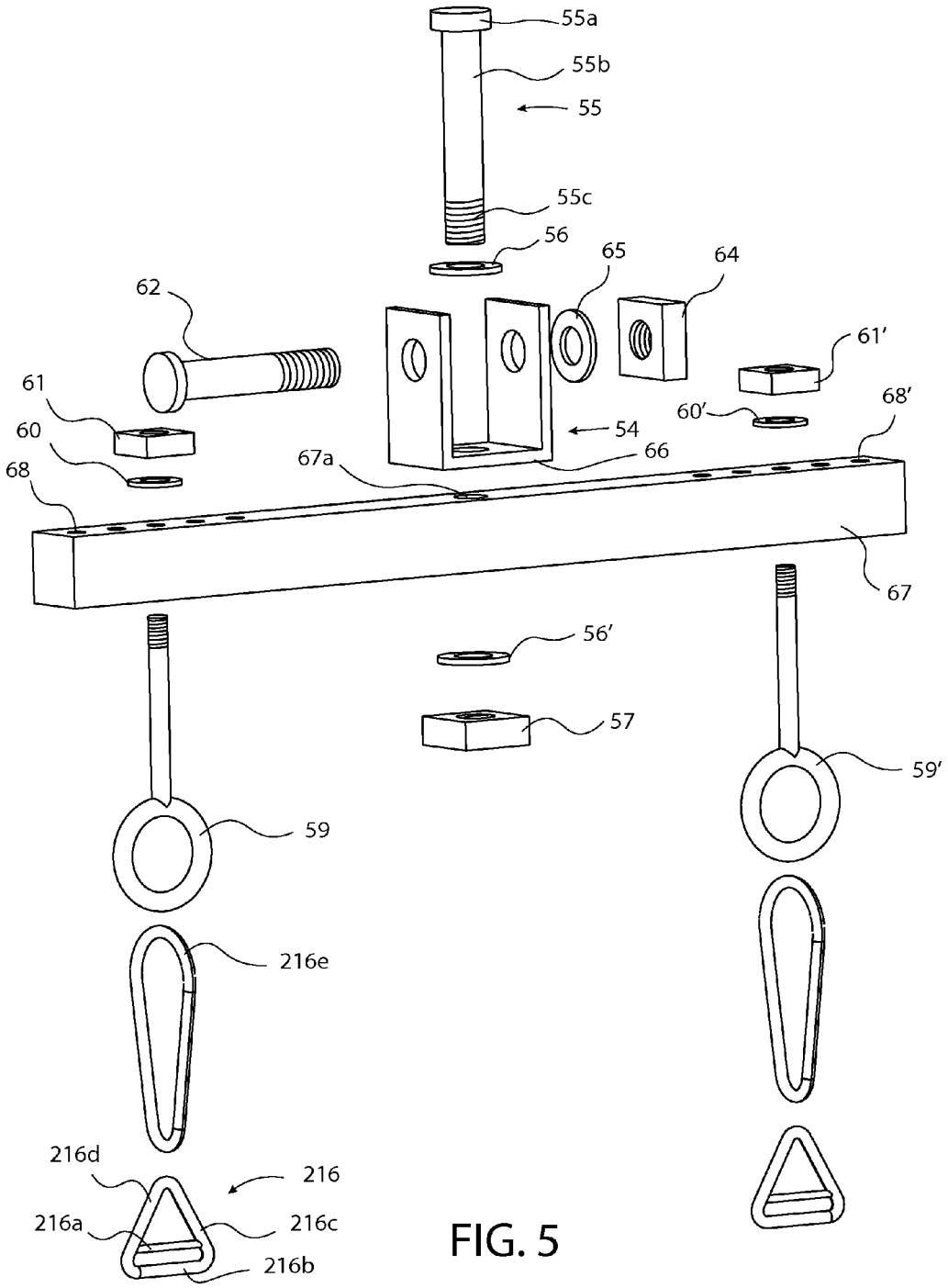
FIG. 5 is a perspective view, with parts separated, of a suspension system of the patient rehabilitation system of FIG. 1.
Figure 5B:
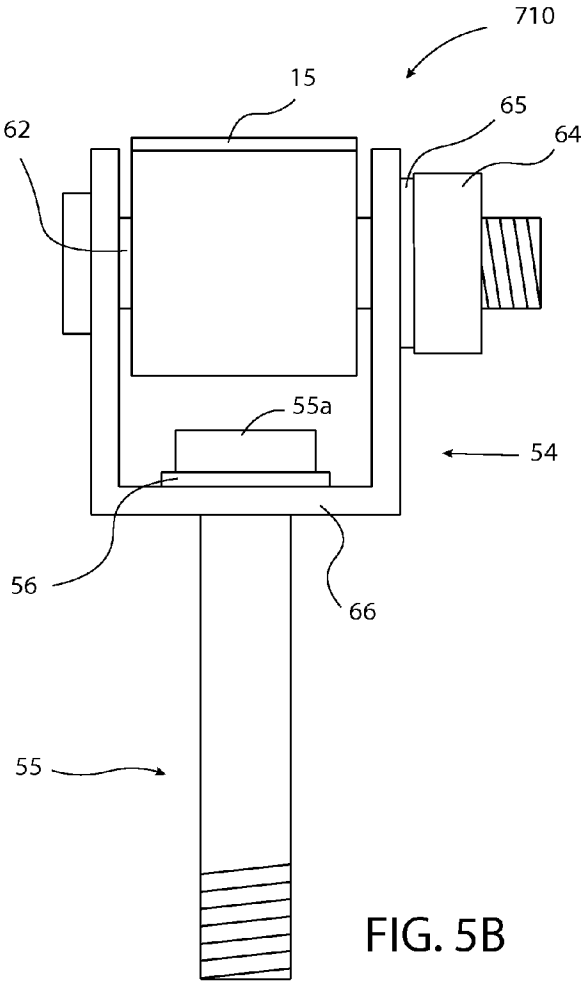
FIG. 5B is a front view of the U-bracket of FIG. 5A.
Figure 5A:
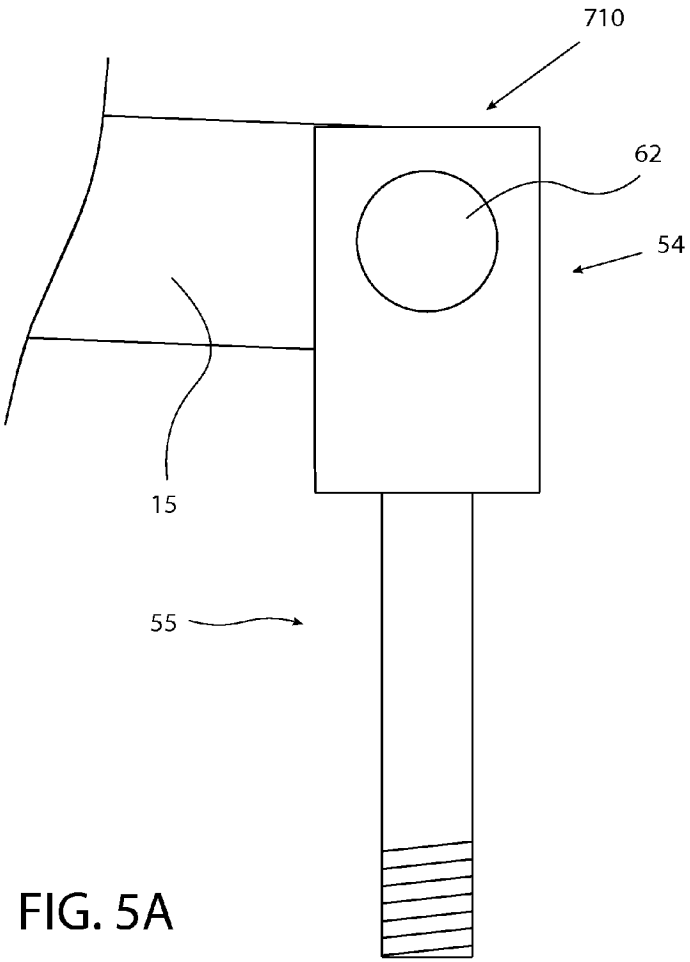
FIG. 5A is side view of a U-bracket of the suspension system of FIG. 5.

Referring now to FIGS. 1 and 5-5B, an embodiment of a suspension system 710 of machine 600 is illustrated. In an embodiment, suspension system 710 is supported on bed frame 18 of the "bed lifter" 700. Suspension system 710 includes U-bracket 54, pivot 62, washer 65, nut 64, pin 55, washer 56, hanger 67, washer 56', nut 57, hooks 59 and 59', latching devices 216*e*, strap hangers 216, and straps 200 and 201 (FIGS. 1 and 5). As illustrated in FIGS. 5A and 5B, U-bracket 54 is rotatably secured to arm 15 of wagon 16 by pivot 62, washer 65, and nut 64. It is contemplated that a locking device such as a cotter pin or other suitable device may be employed to prevent nut 64 from fully backing off pivot 62. Referring now to FIG. 5, pin 55 includes a head 55*a*, an elongate body 55*b* and a threaded shank 55*c*. Pin 55 passes through bottom plate 66 of U-bracket 54 (FIG. 5B). Washer 56 is interposed between head 55*a* of pin 55 and bottom plate 66 of U-bracket 54. Center hole 67*a* is defined through an upper and lower surface of hanger 67 at a location generally bisecting hanger 67. Hanger 67 further includes a plurality of holes 68 and 68' defined through the upper and lower surfaces on opposing ends of hanger 67. Pin 55 passes through center hole 67*a* of hanger 67 and includes washer 56' and nut 57 thereby preventing hanger 67 from translating axially along pin 55. It is contemplated that a locking device such as a cotter pin or other suitable device may be employed to prevent nut 57 from entirely backing off pin 55. Hooks 59 and 59' pass through a respective one of plurality of holes 68 and 68' from underneath hanger 67 and are mechanically secured thereto by washers 60, 60' and nuts 61, 61' respectively (FIG. 5). A plurality of holes 68 and 68' permit selective positioning of hooks 59 and 59' thereby permitting adjustment of straps 200 and 201 to accommodate a wide variety of patients using harness 800 (FIG. 5). Although shown as generally having a triangular shape, strap hanger 216 may be any suitable strap hanger known in the art, such as a double bar d-ring, double bar triangle ring, or the like. The gap between members 216*a* and 216*b* is intended to keep strap 200 in place, so it is not twisting or bunching during storage or during the installation or wearing process. The corner formed by members 216*c* and 216*d* is intended to properly position latching device 216*e*. In operation, member 216*a* inhibits strap 200 from twisting, binding, and/or bunching within strap hanger 216. Latching device 216*e* is adapted and/or configured to releasably engage hook 59 and strap hanger 216, thereby permitting a clinician to easily attach harness 800 to suspension system 710, and vice versa. It is contemplated that any suitable latching 216*e* device may be employed in order to selectively attach strap hanger 216 to hooks 59 and 59', such as a carabiner or the like.

Referring now to FIGS. 7-14, an embodiment of motorized air walker 900 is illustrated. As discussed in the foregoing, motorized air walker 900 is bisected by axis "A". Accordingly, and in the interest of brevity, only one side of motorized air walker 900 will be discussed herein.

Figure 7:
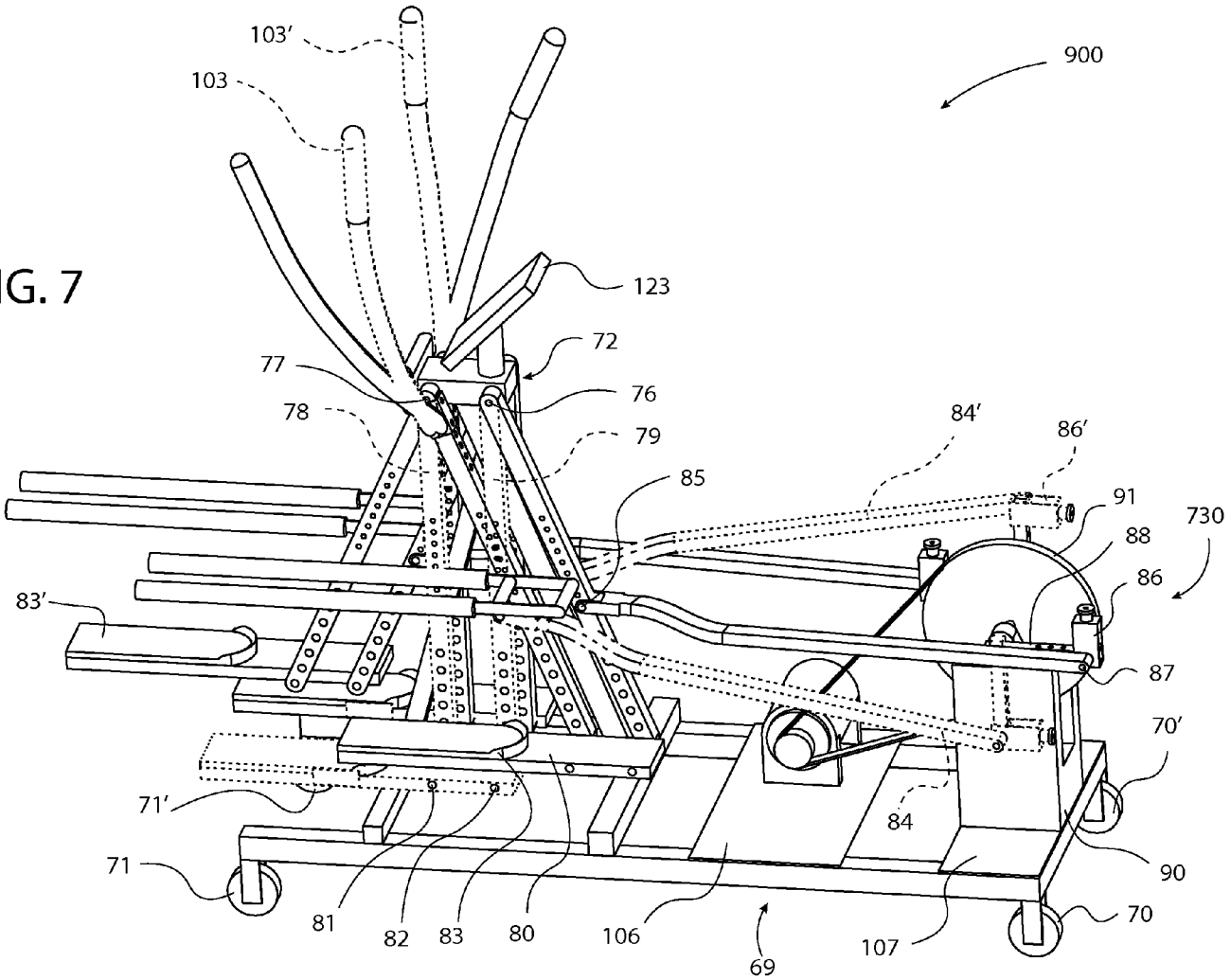
FIG. 7 is a front, perspective view of a motorized air walker of the patient rehabilitation system of FIG. 1.
Figure 11:
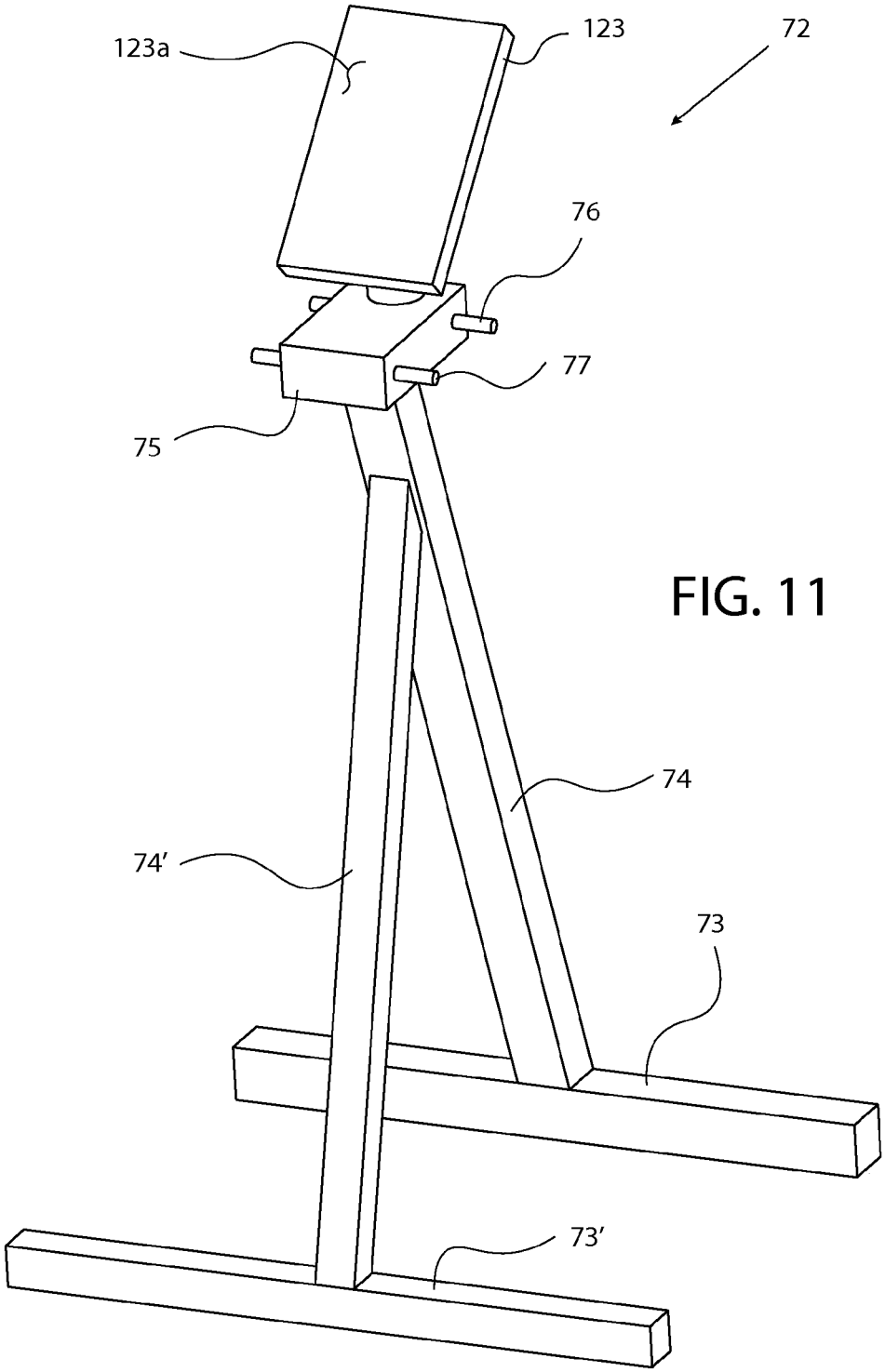
FIG. 11 is a perspective view of a walker support frame of the motorized air walker of FIG. 7.

As illustrated in FIG. 7, motorized air walker 900 includes a base frame 69. Base frame 69 includes four casters 70, 70', 71, and 71', which may include brakes and the ability to swivel. Frame 69 includes walker support frame 72. As best illustrated in FIG. 11, walker support frame 72 includes horizontal base members 73 and 73'. Diagonal support 74 extends from horizontal base member 73 at an incline and is rigidly connected thereto. Vertical support 74' extends vertically from horizontal base member 73' and is rigidly connected thereto. Vertical support 74' terminates on the underside of diagonal support 74 and is rigidly connected thereto. In combination, horizontal base members 73, 73', diagonal support 74 and vertical support 74' form a free standing frame. Disposed on top end of diagonal support 74 is rigidly mounted pivot box 75 including pivots 76 and 77. Pivots 76 and 77 pass through pivot box 75 and are rigidly connected thereto.

Figure 16B:
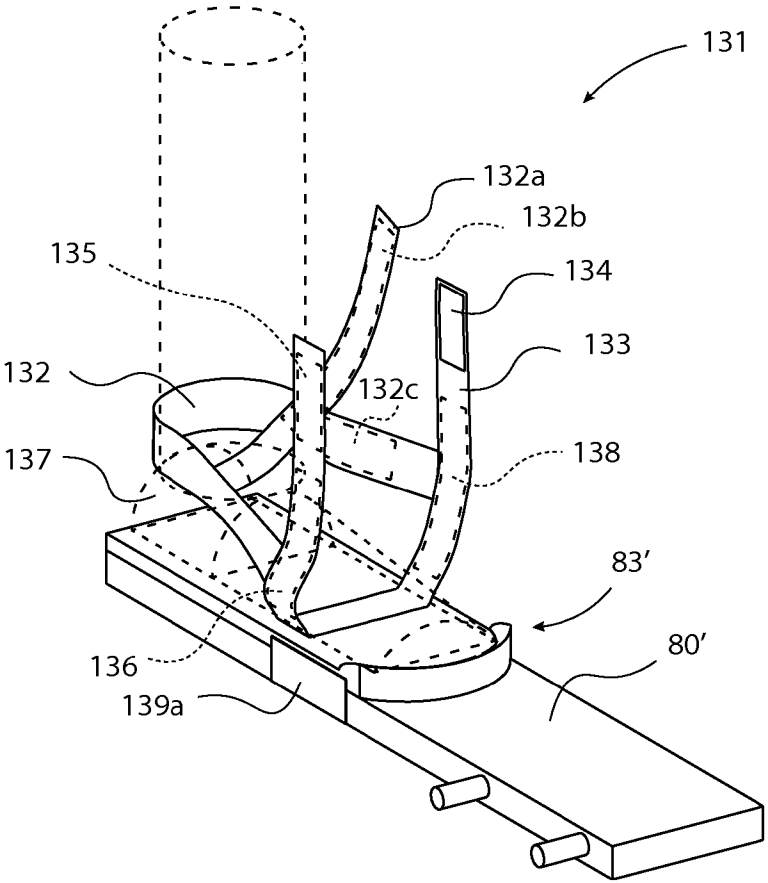
FIG. 16B is a right/inside, perspective view of the left foot strap of FIG. 16A, shown in an open position.
Figure 17B:
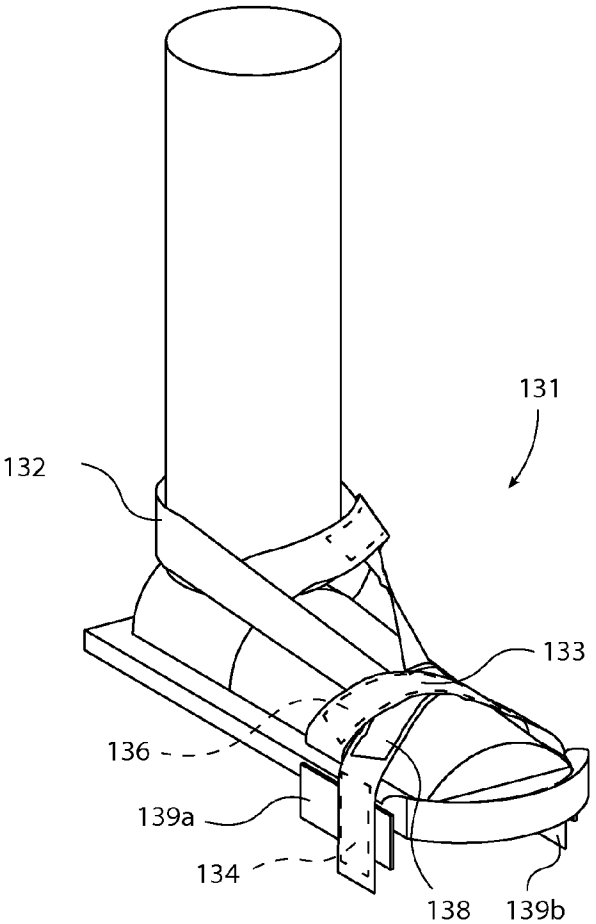
FIG. 17B is a right/inside, perspective view of the left foot strap of FIG. 16B, shown in a closed position.
Figure 17A:
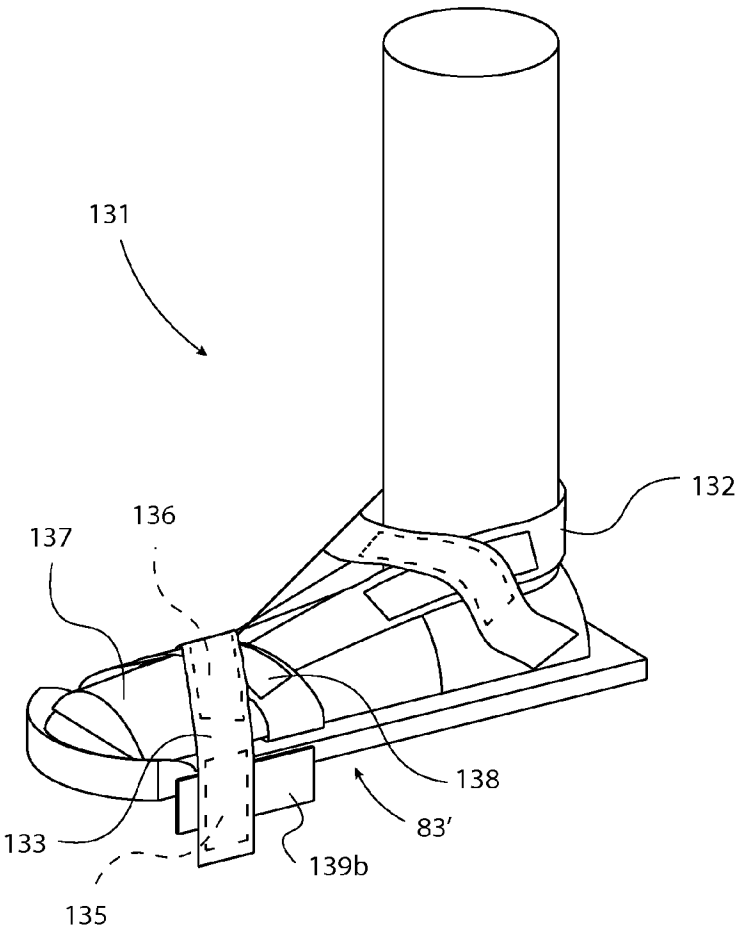
FIG. 17A is a left/outside, perspective view of the left foot strap of FIG. 16A, shown in an closed position.

Referring back to FIG. 7, motorized air walker 900 includes leg members 78 and 79 rotatably supported on an upper end by pivots 77 and 76, respectively. Foot support base 80 includes pivots 81 and 82 and is rotatably supported by leg members 78 and 79 thereon such that foot support base 80 remains substantially level during rotation of leg members 78 and 79. Foot support 83 is disposed on an upper surface of foot support base 80 and retains the patient's foot while in operation (FIGS. 1, 16B, and 17A).

Figure 7A:
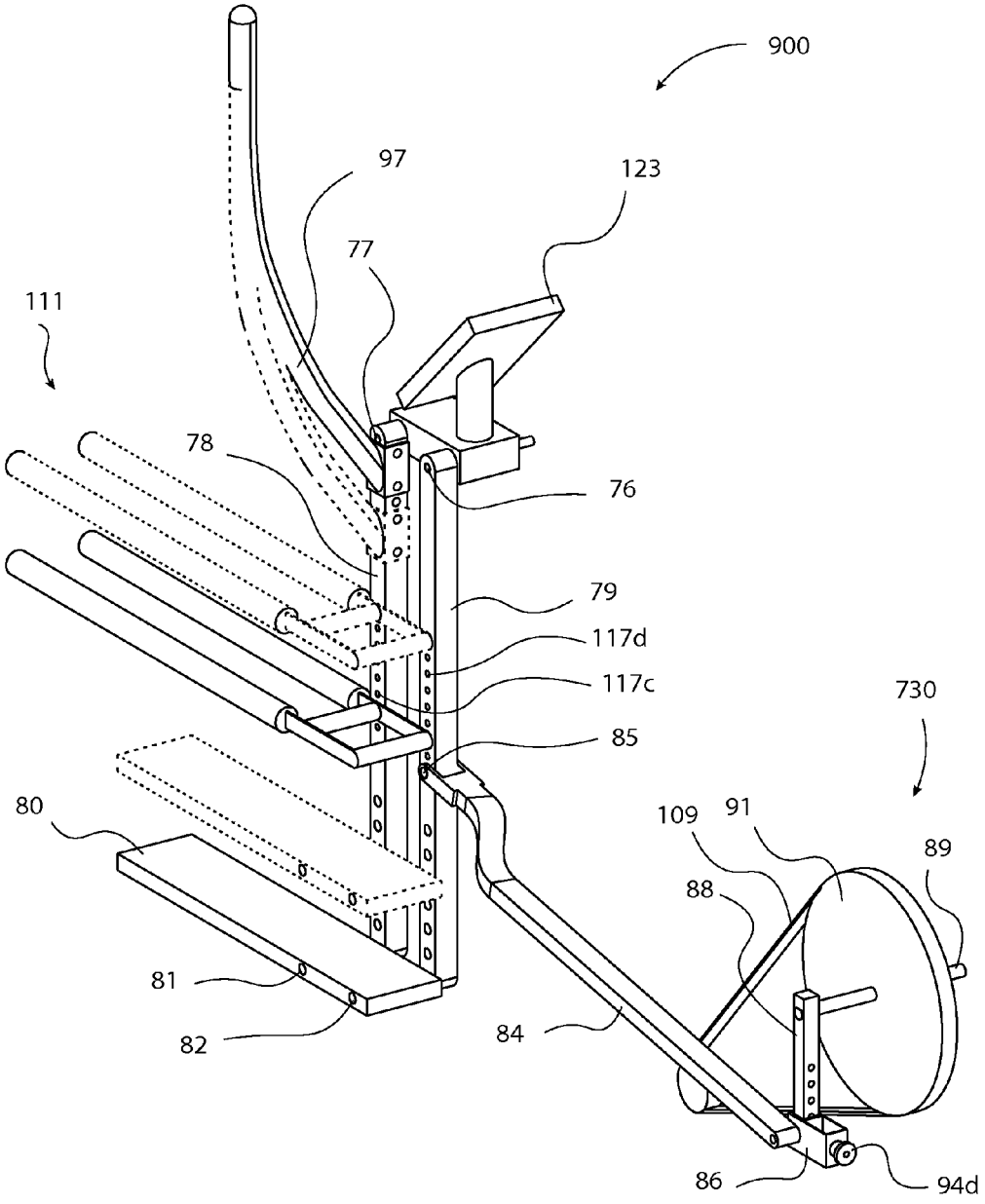
FIG. 7A is a perspective view of an adjustment system of the motorized air walker of FIG. 7, shown in two height positions.
Figure 8:
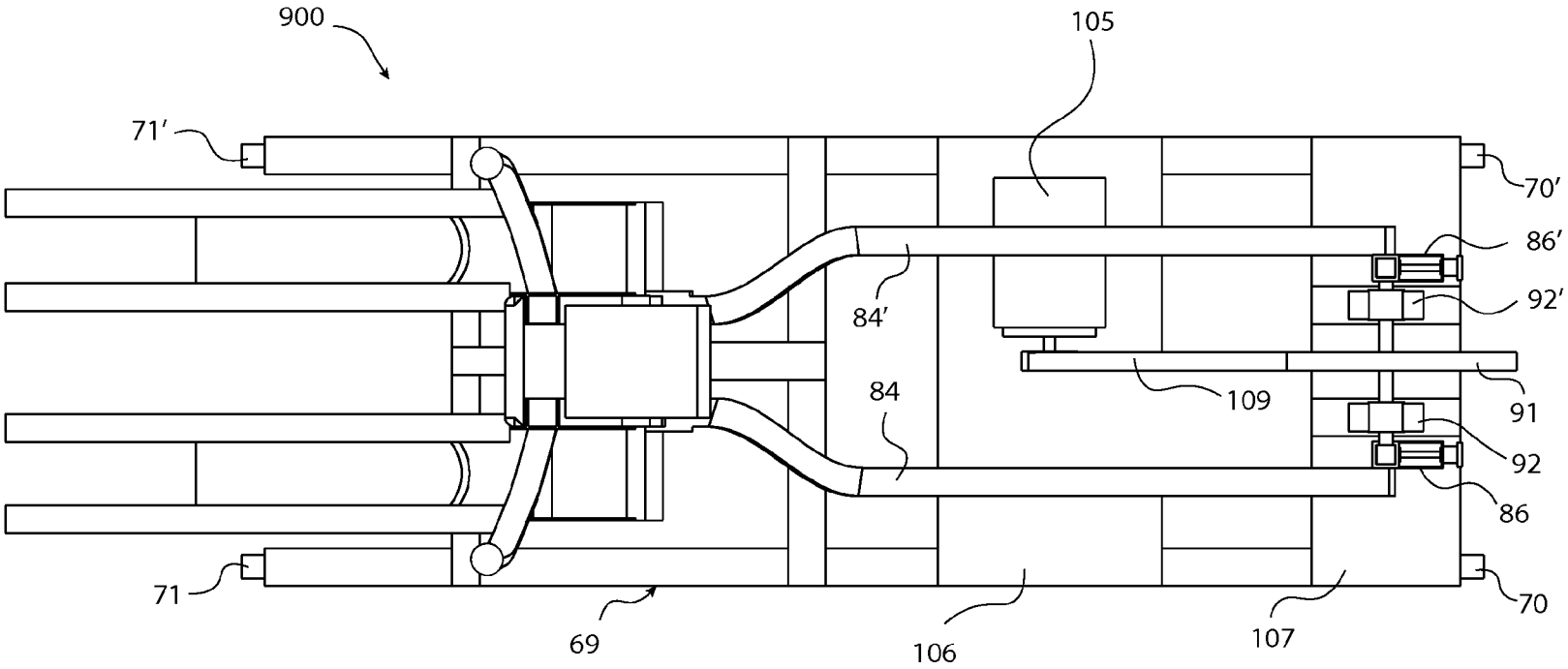
FIG. 8 is a plan view of the motorized air walker of FIG. 7, shown in a neutral or start/end position.
Figure 9:
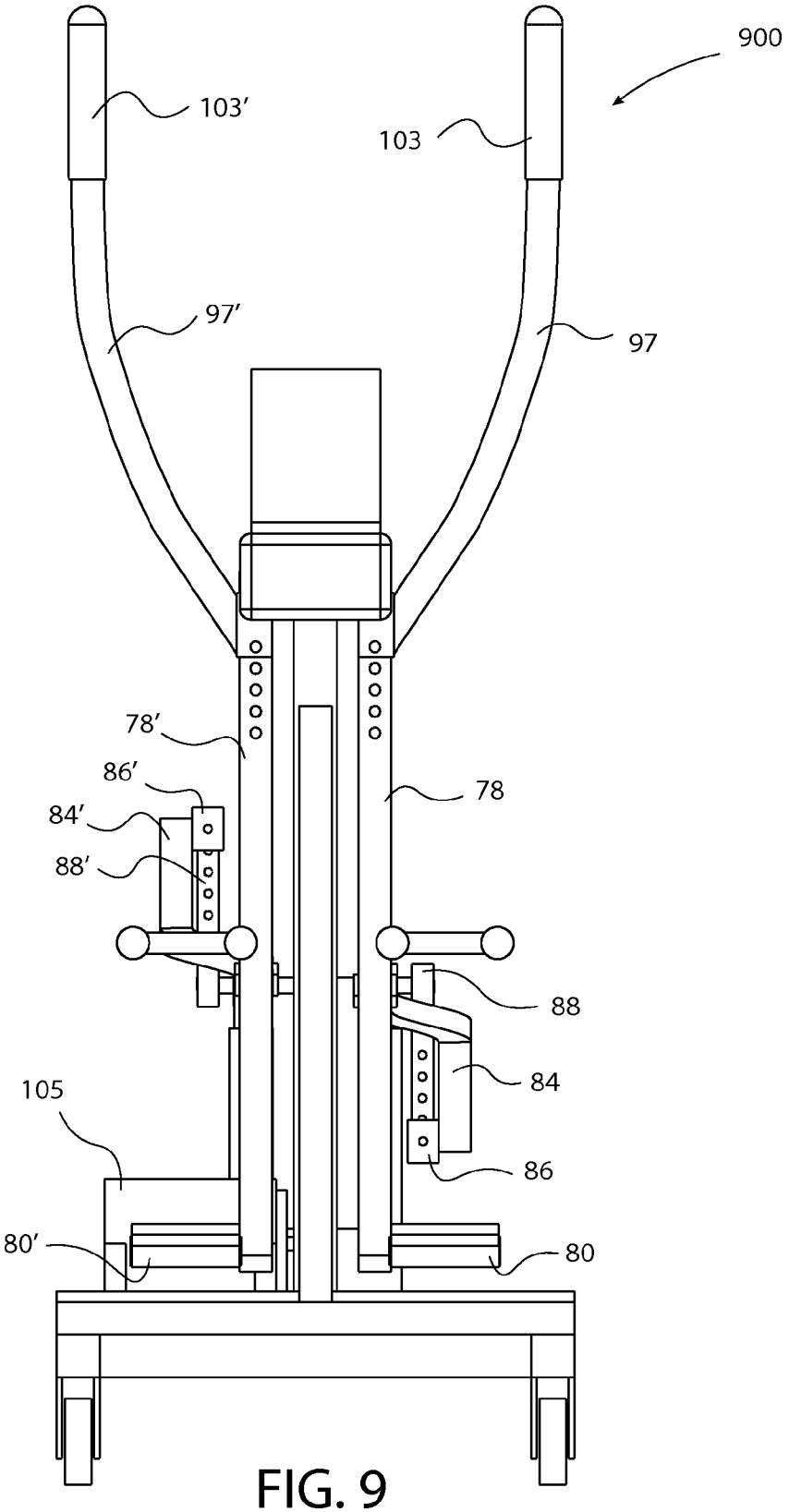
FIG. 9 is a rear view of the motorized air walker of FIG. 7.
Figure 10:
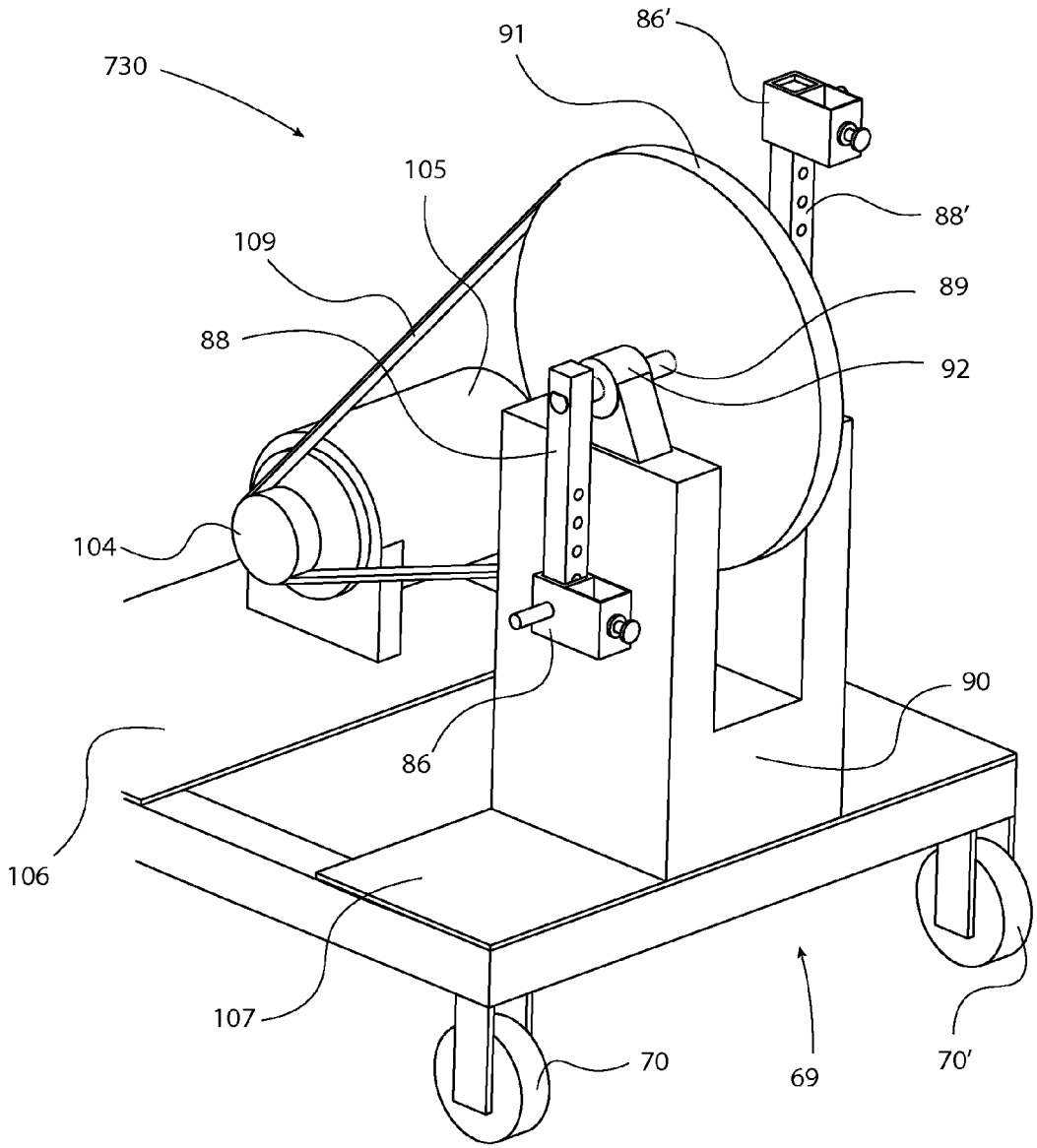
FIG. 10 is a perspective view of a reciprocator of the motorized air walker of FIG. 7.
Figure 12A:
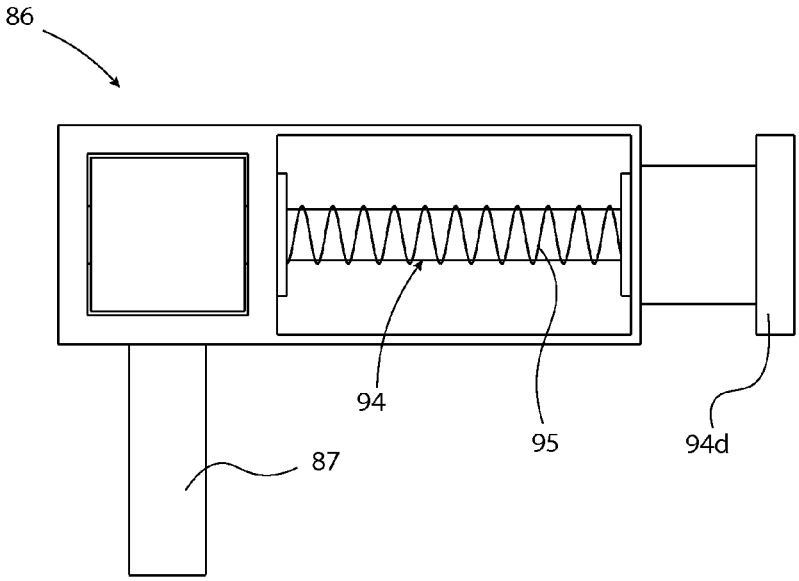
FIG. 12A is side view of a pivot block of the motorized air walker of FIG. 7, shown in an initial, closed state.
Figure 12B:
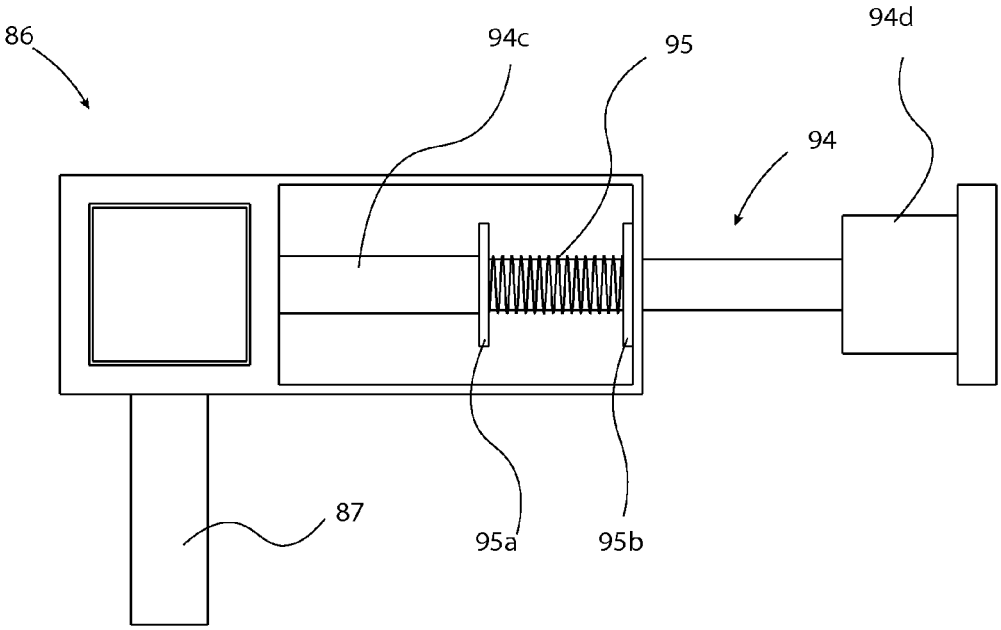
FIG. 12B is a side view of the pivot block of FIG. 12A, shown in a second, open state.
Figure 12C:
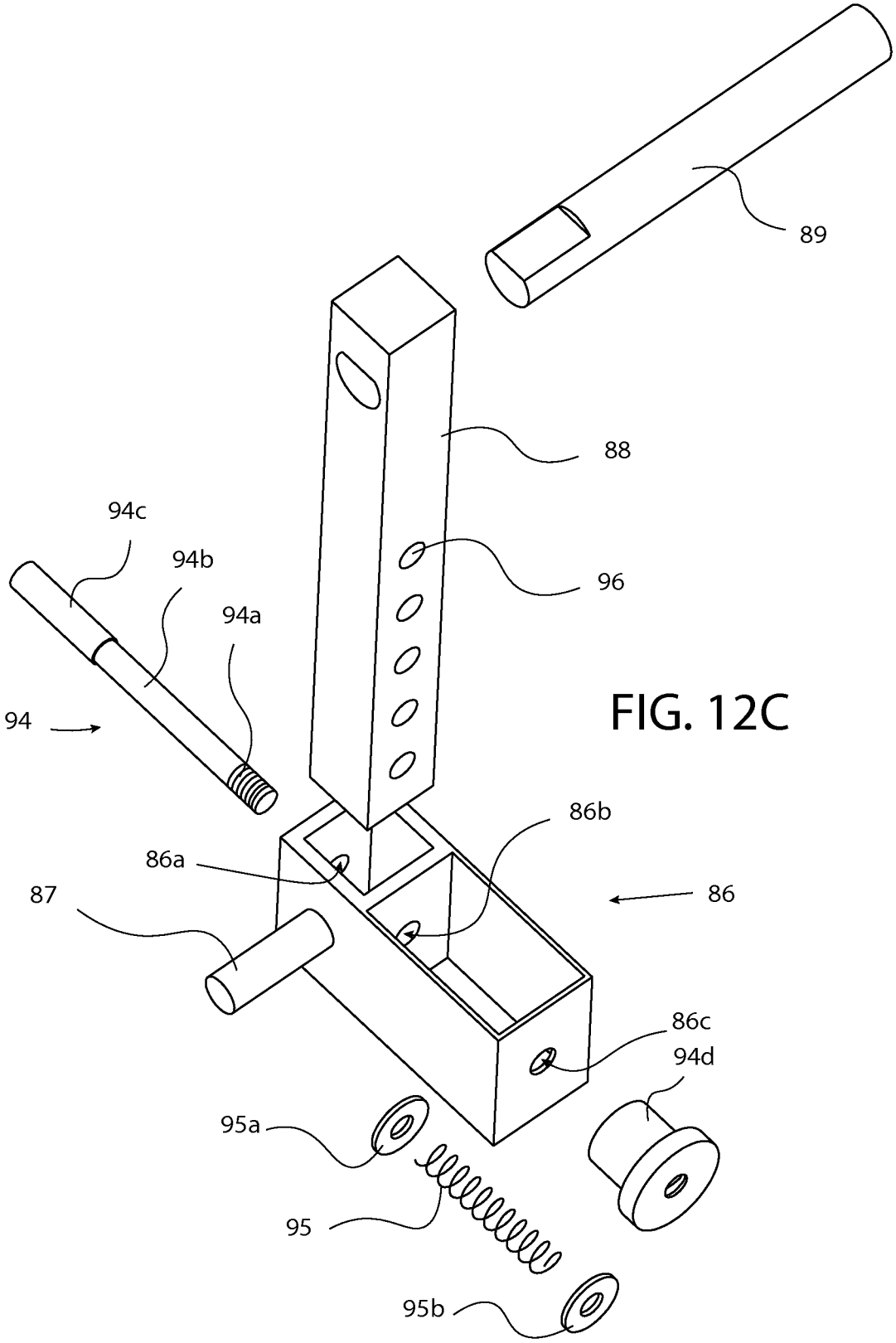
FIG. 12C is a perspective view of the pivot block of FIG. 12A, with parts separated.

With reference to FIGS. 7, 7A, and 10, motorized air walker 900 includes reciprocator 730. Reciprocator 730 includes pivot block 86, adjustment bar 88, motor 105, flywheel 91, and reciprocator frame 90. Reciprocator frame 90 is generally shown as having a U-shape and is rigidly connected to reciprocator frame base 107. Reciprocator frame base 107 is rigidly connected to base frame 69. An upper end of reciprocator frame 90 includes journal bearings 92 and 92' (FIG. 8) which are mechanically secured thereto via any suitable means known in the art, such as a bolted connection. An axle 89 is rotatably supported by journal bearings 92 and 92'. Flywheel 91 includes a plurality of gear teeth (not shown) and is disposed within reciprocator frame 90 and is rotatably supported by axle 89. Adjustment bars 88 and 88' are disposed on either end of axle 89 and are mechanically secured thereto using any suitable means such as threaded, interference fit, set screw, or the like. Adjustment bars 88 and 88' are arranged such that each extends in opposite directions (i.e. 180 degrees apart). Disposed on adjustment bars 88 and 88' are pivot blocks 86 and 86' respectively. As best illustrated in FIGS. 12A-C, pivot blocks 86 and 86' are mechanically secured to adjustment bars 88 and 88' by pivot pins 94 and 94' to one of a plurality of holes 96 and 96' defined within adjustment bars 88 and 88'. Motor 105 includes motor base 106 and is rigidly connected to base frame 69. Motor 105 may include a speed reduction gearbox. Sprocket 104 is in mechanical cooperation with an output shaft of motor 105. Sprocket 104 may be affixed to the output shaft of motor 105 by any means known in the art, such as keyway, spline, split collar, or the like. Rotation of sprocket 104 is transmitted to flywheel 91 by drive chain 109. It is contemplated that drive chain 109 may be replaced by a belt, gear train, direct drive in order to transmit rotation of the output shaft of motor 105 to flywheel 91.

Leg member 79 includes pivot 85 and control member 84. Control member 84 is pivotably connected on one end to leg member 79 through pivot 85. The opposite end of control member 84 is pivotably connected to pivot block 86 through pivot 87 (FIGS. 7 and 12C).

Figure 13:
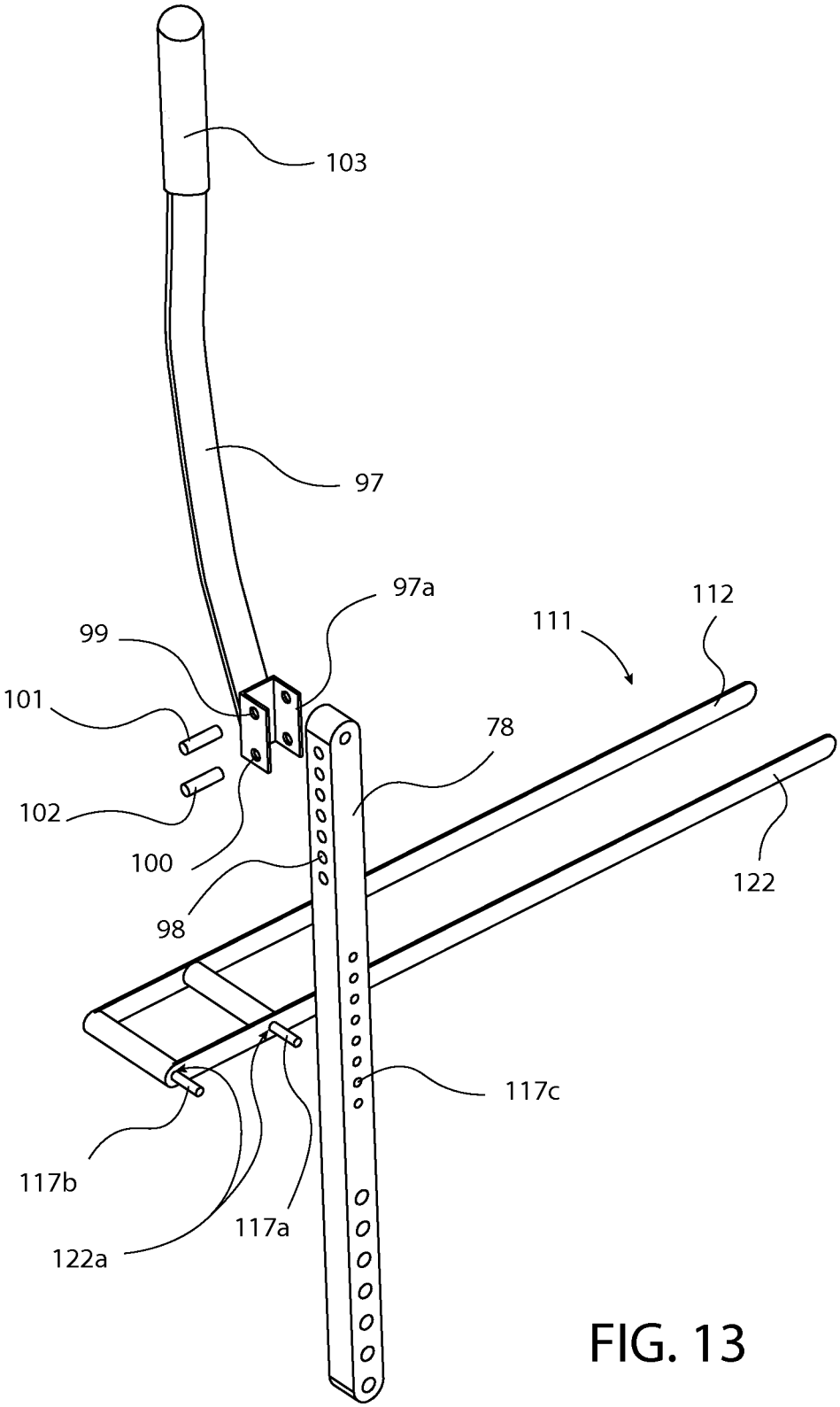
FIG. 13 is a perspective view of a leg member and hand supporting tube of the motorized air walker of FIG. 7.

Referring now to FIG. 13, an embodiment of hand supporting tube 97 is shown. Hand supporting tube 97 includes a U-shaped channel 97*a* rigidly secured thereto. U-shaped channel 97*a* includes a plurality of holes 100 and 99 defined through outer and inner surfaces of each arm of the U-shaped channel 97*a*. Hand supporting tube 97 extends from U-shaped channel 97*a* at an acute angle so as to form a handle for which the patient may grip during locomotion. Leg member 78 includes a plurality of holes 98 defined therethrough. U-shaped channel 97*a* is slideably supported by leg member 78 and may be secured thereto by pins 101 and 102 when disposed within one of plurality of holes 99, 100, and 98. An upper end of hand supporting tube 97 includes hand grip 103.

Motorized air walker 900 has the capability of stroke adjustment depending upon the needs of each patient. As illustrated in FIGS. 12A-12C, pivot pin 94 includes an elongate body 94*b* including threads 94*a* disposed on a first end and a boss 94*c* disposed on a second end. Threads 94*a* are configured to threadably engage knob 94*d*, such that a force imparted on knob 94*d* translates pivot pin 94 within longitudinal holes 86*a*, 86*b*, 86*c* defined through pivot block 86. Boss 94*c* is configured to selectively engage one of the plurality of holes 96 of adjustment bar 88. Pivot pin 94 is biased by a spring 95. Spring 95 is coaxially aligned with pivot pin 94 and is disposed within pivot block 86. A pair of washers 95*a*, 95*b* is disposed on either end of spring 95, thereby biasing pivot pin 94 in a depressed position, fully engaging pivot pin 94 within one of plurality of holes 96 of adjustment bar 88. Pulling knob 94*d*, thereby retracting pivot pin 94, allows pivot block 86 to slide along adjustment bar 88 and positioned at a desired one of plurality of holes 96 to set a desired stroke. Calculations may be performed to determine which one of plurality of holes 96 relates to the required length of stroke of foot support 83. A mark may be placed next to the corresponding one of plurality of holes 96 so when an adjustment is made, both sides of motorized air walker 900 can be set to have the same stroke. This marking may also help to avoid any mistakes with the adjustment of the stroke by eliminating the need to count the number of plurality of holes 96 while setting the stroke. Each one of plurality of holes 96 may be marked with different colors to minimize the risk of having a mismatch of stroke during adjustment. When pivot block 86 is adjusted towards axle 89 and pivot pin 94 is mounted in one of the plurality of holes 96 located closest to axle 89, the length of the stroke is at its minimum. Longer strokes may be obtained by sliding pivot block 86 away from axle 89. When pivot pin 94 is disposed within one of plurality of holes 96 located furthest away from axle 89 the length of the stroke is at its maximum. The position of motorized air walker 900 is defined by the position where the stroke/stride adjustment may be easily accessed from the rear by removing panel 1210 (FIG. 24), as will be discussed in further detail below.

Referring back to FIGS. 7A and 13, details of the stroke adjustment for hand supporting tube 97 are illustrated. Hand supporting tube 97 may be adjusted to accommodate varying heights of patients (e.g. adult or child), as well as the needs of each patient relative to the state of their rehabilitation (i.e. shorter strokes or longer strokes). The embodiment disclosed herein is not meant to be limiting. It is contemplated that other means of adjustment of the hand supporting tube may be applied. In the case of a child or a person with a height lower than the average adult, the adjustment of hand supporting tube 97 will need to be done. As illustrated in FIG. 13, the position of hand supporting tube 97 can be adjusted by releasing pins 101 and 102 and sliding hand supporting tube 97 along leg member 78 until two of the plurality of holes 99 and 100 is coaxially aligned with two of the plurality of holes 98. Hand grip 103 is rigidly mounted to hand tube 97 using any suitable means known in the art.

In operation, when pivot blocks 86 and 86' are properly positioned to achieve the same stroke, rotation of the adjustment bars 88 and 88' (FIG. 10) causes rotation of pivot blocks 86 and 86' around axle 89. As pivot block 86 is in mechanical cooperation with control member 84 through rotational support of pivot 87 (FIGS. 7 and 12C), rotation of pivot 87 about axle 89 causes control member 84 to follow the rotation of pivot 87 on one end, while the opposite end reciprocates longitudinally about pivot 85 of leg member 79. The reciprocating motion of pivot 85 causes corresponding oscillating motion of leg member 79 around pivot 76, thereby causing a swinging motion at pivot 82 of foot support base 80. The foregoing motion of pivot 82 causes foot support base 80 with foot support 83 (FIGS. 1, 7, and 7A) to move in a corresponding swinging motion. Movement of foot support 83 towards motor 105 causes leg member 78 to rotate about pivot 77 towards motor 105 by rotational support of pivot 81, and causes hand grip 103 on hand tube 97 (FIG. 1) to swing away from motor 105 about pivot 77. When the patient's right hand holds grip 103 and the patient's right foot rests on foot support 83 while motor 105 is active, the patient's right hand and right foot are caused to move in opposite directions. This results in a walking-like movement (i.e. locomotion). The same logic applies to the left side of motorized air walker 900 (e.g. when right foot support 83 moves towards motor 105 then left foot support 83' moves away from motor 105, and when right hand grip 103 moves away from motor 105, left hand grip 103' moves towards motor 105).

Figure 14:
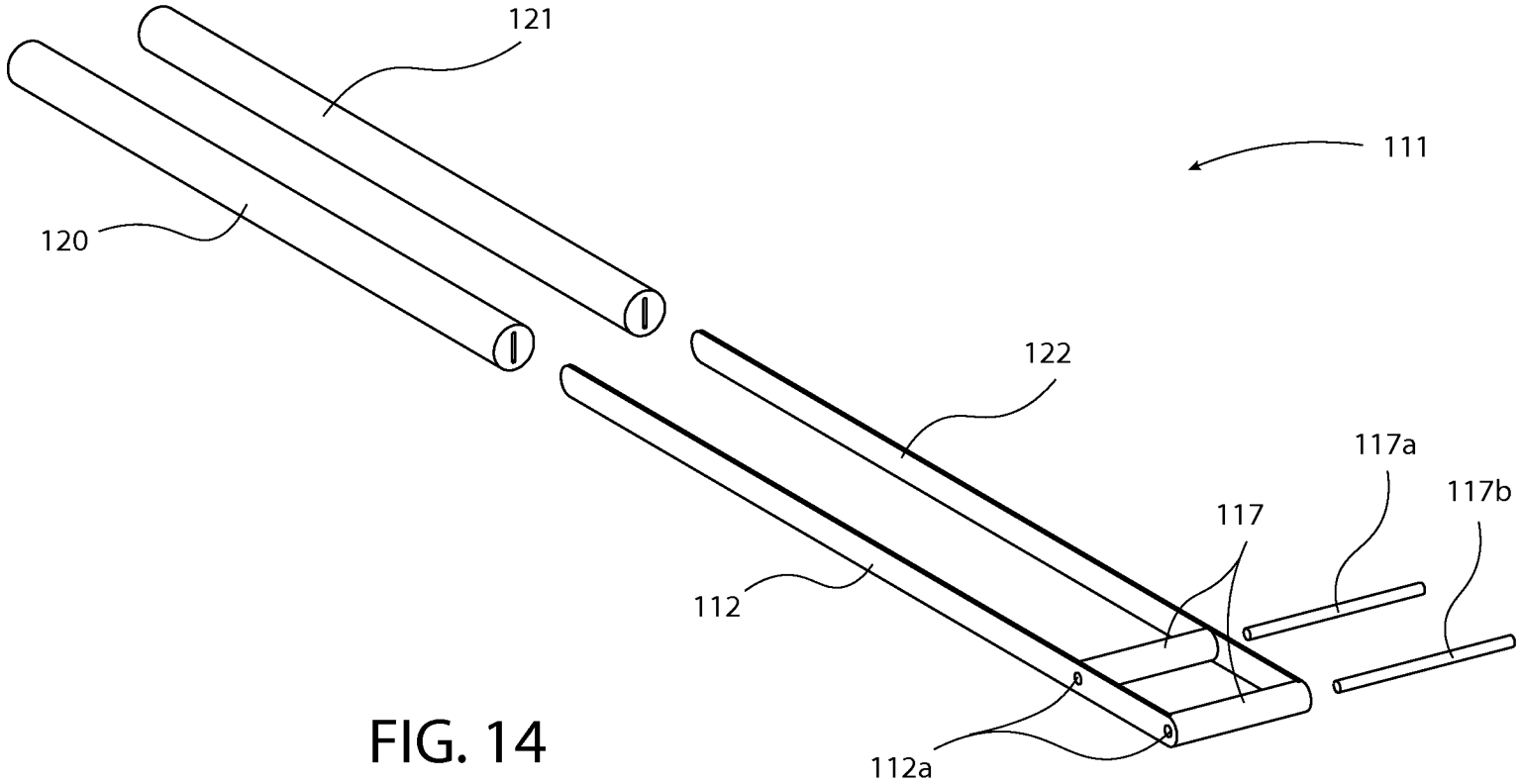
FIG. 14 is a perspective view of a knee guiding mechanism of the motorized air walker of FIG. 7.
Figure 18:
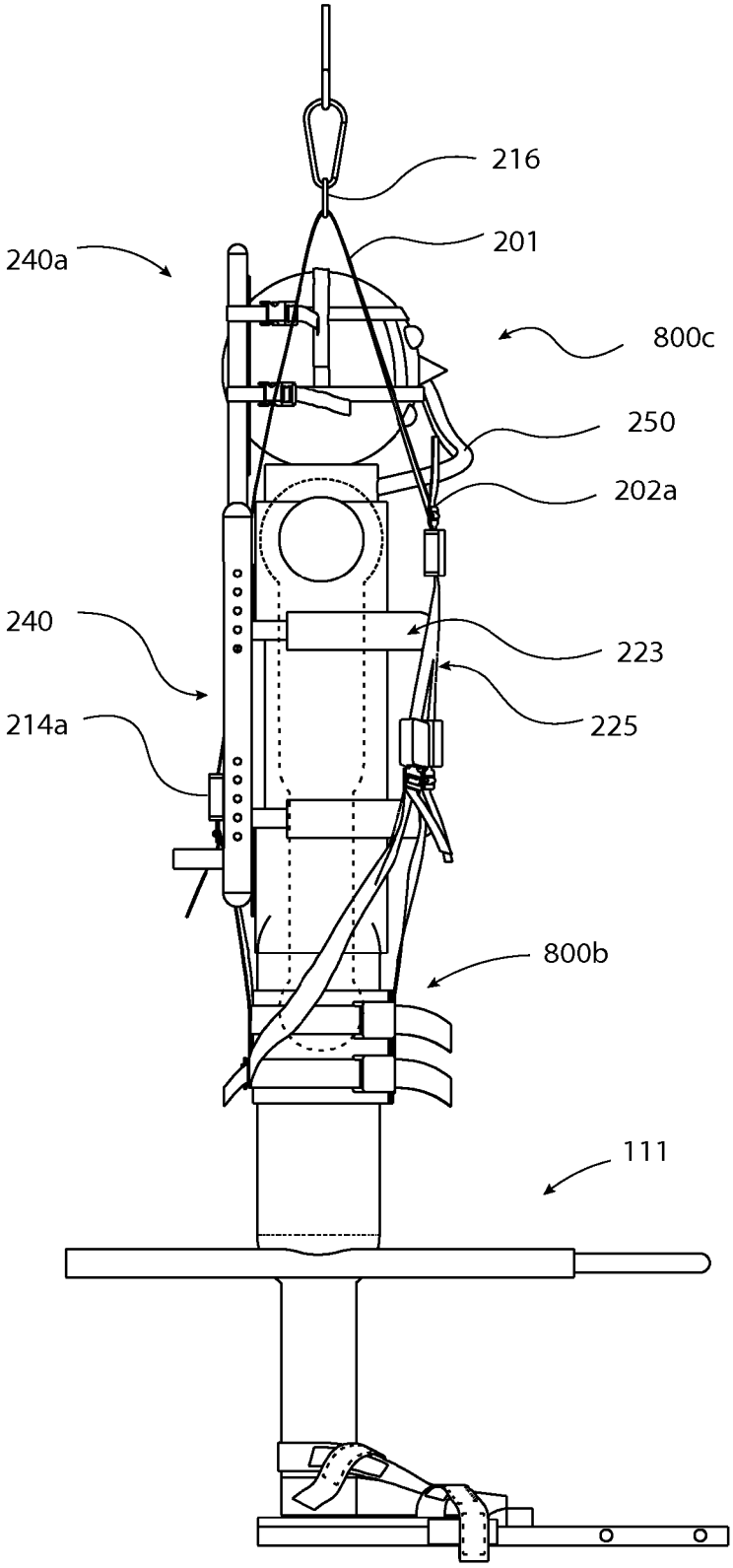
FIG. 18 is a side view of a harness of the patient rehabilitation system of FIG. 1.
Figure 18A:
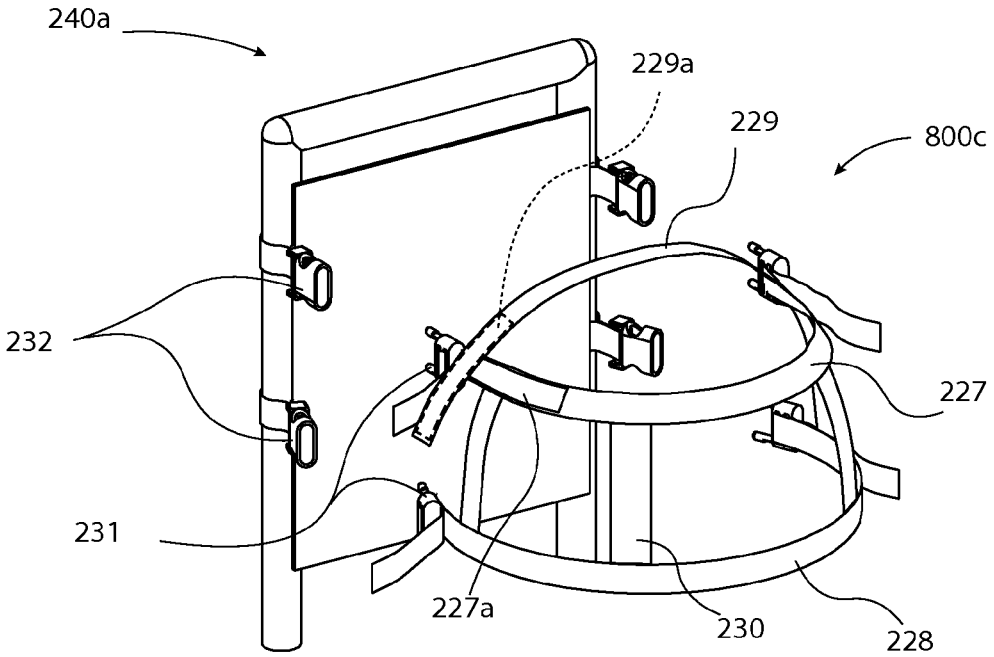
FIG. 18A is a perspective view of a head harness of the harness of FIG. 18.

Referring now to FIGS. 13, 14, and 18, knee guiding mechanism 111 is illustrated. Knee guiding mechanism 111 is generally of a U-shape and includes parallel extending arms 112 and 122. Arms 112, 122 include a plurality of apertures 112*a*, 122*a* (FIG. 13), configured to receive pins 117*a*, 117*b*, respectively. Knee guiding mechanism 111 includes stiffening members 117 interposed between arms 112 and 122. Stiffening members 117 are configured to receive pins 117*a*, 117*b* therethrough, and although generally shown as having a cylindrical shape, it is contemplated that stiffening members 117 may include any suitable shape, such as square, oval, hexagonal, or the like. It is contemplated that stiffening members 117 may be secured to arms 112, 122 by any suitable means, such as a bolted connection, welding, etc. Pins 117*a*, 117*b* are configured to be received within one of the plurality of holes 117*c*, 117*d* (FIGS. 7A and 13) of leg members 78 and 79 such that knee guiding mechanism 111 is rotatably secured to each of leg members 78 and 79. Arms 112 and 122 are constructed of a suitable material having some flexibility, but retaining enough rigidity to be able to transversely support/guide the patient's knee.

Continuing with FIG. 14, knee guiding mechanism includes knee sliders 120 and 121. Each of knee slider 120 and 121 are configured and/or dimensioned to slide over each of arms 112 and 122 respectively and be retained thereon by any suitable means, such as frictionally, by adhesives, etc. Knee sliders 120 and 121 may be constructed of a material having low friction and elasticity such that knee sliders 120 and 121 may be deformed by the patient's knee thereby causing each of knee sliders 120 and 121 to be in contact with the patient's knee at all times (FIG. 18). Although generally shown as having a circular cross section, it is contemplated that knee sliders 120 and 121 may also include a D-shaped profile such that there is a round profile on each side facing the patient's knee, and a corresponding planar profile opposite thereto. It may be beneficial for the patient to wear sweat pants or other similar garment during operation of the motorized air walker 900 so the fabric from the garment will slide against the rounded surface of each of knee sliders 120 and 121 thereby causing the knee to be in contact with only the inside texture of the garment. This will minimize irritation of skin in the patient's knee area contacting the knee sliders 120 and 121.

As noted in the foregoing, each side of motorized air walker 900 is mirrored about axis "A" (FIG. 2) and therefore the left side of motorized air walker 900 includes the same features as the right.

As illustrated in FIG. 11, motorized air walker 900 may include a monitor 123. Monitor 123 includes a processor (not shown) and memory (not shown). The microprocessory may be any suitable microcontroller, microprocessor, PLD, PLA, or other suitable digital logic. The memory may be volatile, non-volatile, solid state, magnetic, or other suitable storage memory. Monitor 123 may include a touch screen 123*a*, including dashboard software stored within the memory, which is executed using the processor and can be used to start and stop motorized air walker 900, modify the speed of motor 105, calculate the distance walked, display the time of day, time of session, or display motivational phrases to increase self-esteem, motivation, etc. As can be appreciated, the clinician or patient may name and record sessions on the memory which can then be accessed at a later time to monitor and analyze the patient's rehabilitation progress. It is also contemplated that a plurality of sensors, which are in electrical communication with the processor, may be disposed on adjustment bar 88 and/or pivot block 86 to identify the position of pivot pin 94 and calculate the distance the patient has walked.

Figure 15:
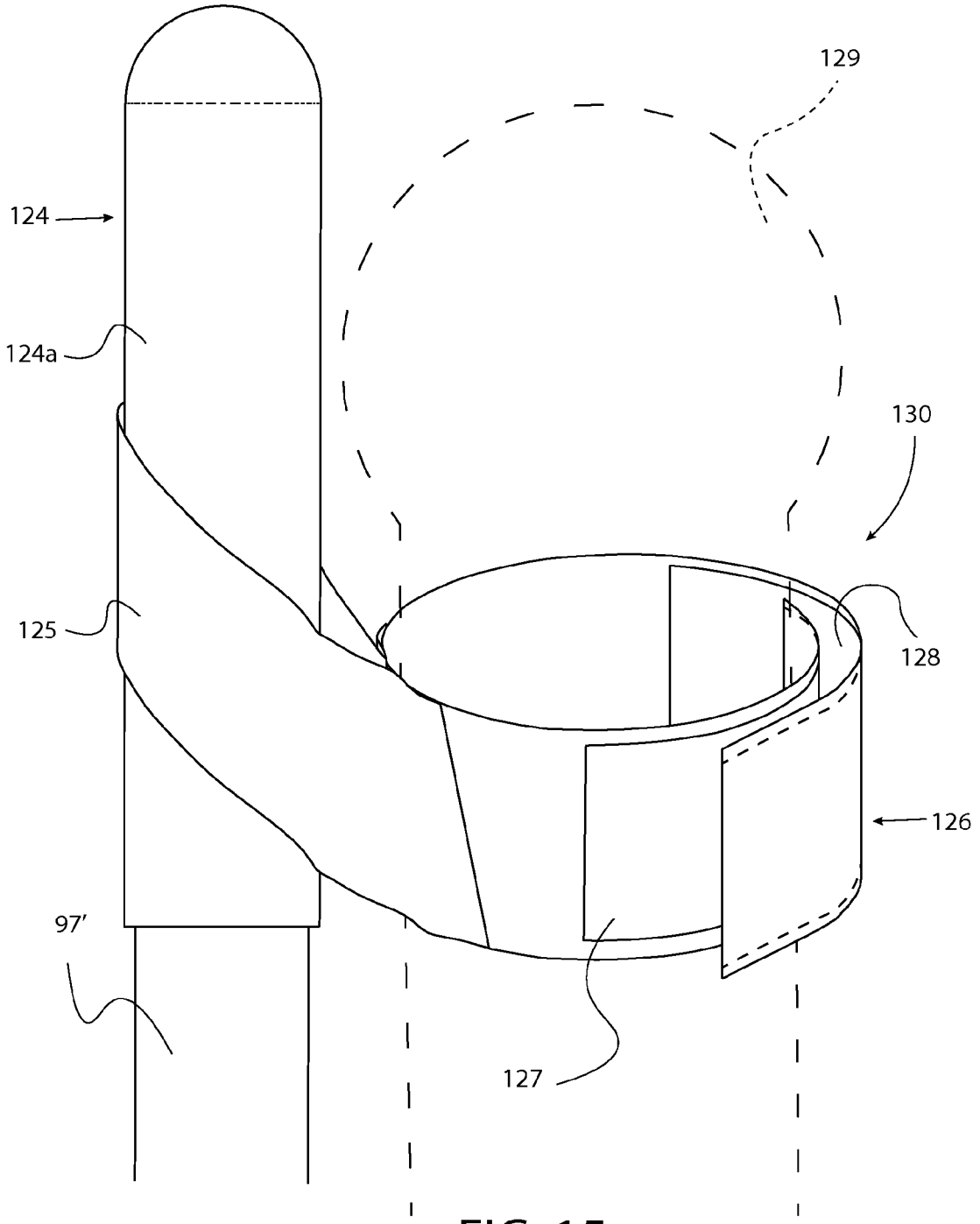
FIG. 15 is a side view of a left hand strap of the motorized air walker of FIG. 7.

FIG. 15 illustrates an embodiment of left hand strap 130. Hand strap 130 includes loop 125, sleeve 124, and fastening strap 126. Sleeve 124 includes an elongate body 124*a* having a closed proximal end and an open distal end defining a cavity therein. The cavity is configured and/or dimensioned to be able to advance over hand grip 103, 103'. Loop 125 is mechanically secured to sleeve 124 and is configured and/or dimensioned to articulate from a position normal to elongate body 124*a* to parallel thereto in either proximal or distal directions. An end of loop 125 includes fastening strap 126 mechanically secured thereto in a position normal to loop 125. Fastening strap 126 includes a proximal end including hook/loop patch 127 and a distal end including hook/loop patch 128. Patches 127 and 128 are configured such that each may be selectively secured to each other. Hook/loop patch 128 may include loops, and may be on the side of fastening strap 126 where a patient's hand 129 may come into contact therewith. Hook/loop patch 127 may include hooks and may be on the opposite side of fastening strap 126 such that a patient's hand 129 may not come into contact therewith.

In operation, when sleeve 124 is advanced over grip 103', a patient may then place their hand 129 on fastening strap 126 on the side which contains hook/loop patch 128, including loops. The patient or clinician may then wrap fastening strap 126 around their hand and/or wrist 129 such that hook/loop patch 127, including hooks, is on top of the patient's hand 129 such that the hook/loop patch 127 does not directly touch the patient's skin. At this point, the end of strap 126 including hook/loop patch 128 is wrapped around the patient's hand 129 such that hook/loop patch 128 engages hook/loop patch 127, thereby securing the patient's hand therein. In this manner, as best illustrated in FIGS. 1, 1A, and 2, the orientation of sleeve 124 with respect to the patient's hand 129 is such that the patient may easily grasp grip 103', since the joint between hook/loop patches 127 and 128 is located outside of the patient's hand 129, thereby inhibiting interference with the patient's grasp of grip 103'. A similar operation as described in the foregoing may be performed for the patient's right hand with strap 126' (FIG. 1).

Figure 16A:
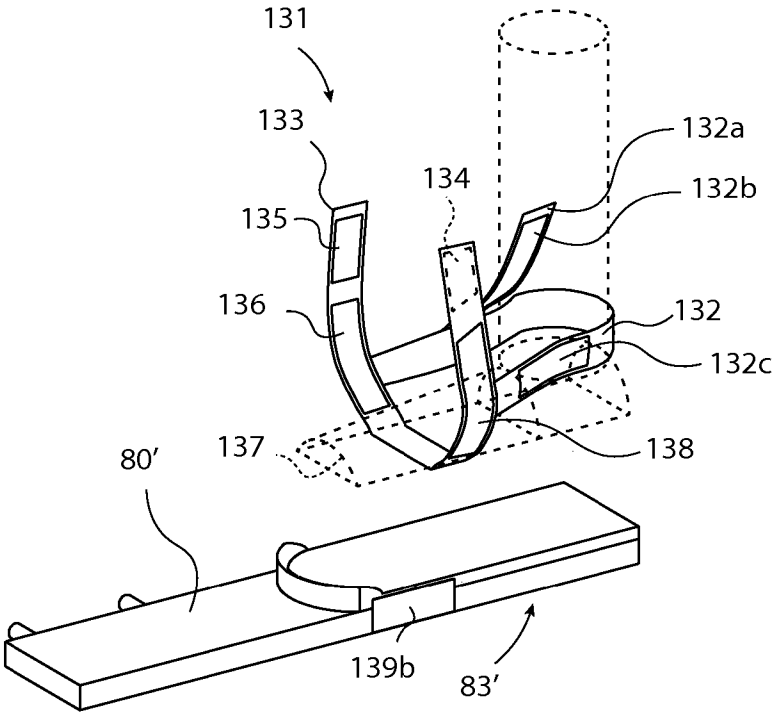
FIG. 16A is a left/outside, perspective view of a left foot strap of the motorized air walker of FIG. 7, shown in an open position.

Referring now to FIGS. 16A and 16B, an embodiment of foot strap 131 is illustrated. Foot strap 131 includes lower strap 133 including proximal and distal ends. The proximal end of foot strap 131 includes a hook/loop patch 134, and the distal end includes a hook/loop patch 135. Additionally, the distal end of foot strap 131 includes a hook/loop patch 136 disposed proximally of hook/loop patch 134 and the same side of lower strap 133 as hook/loop patch 135. Furthermore, the proximal end of foot strap 133 includes a hook/loop patch 138 disposed distally from hook/loop patch 134, but on the opposite side of lower strap 133. Foot strap 131 includes heel strap 132 having proximal and distal ends rigidly connected thereto and is configured and/or dimensioned to accept a patient's heel. Foot strap 131 is mechanically secured to foot support 83' such that, in operation, foot strap 131 retains the patient's foot 137 within foot support 83'.

In operation, a patient may secure their foot 137 using foot strap 131 while standing on foot support 83'. A patient or clinician may place the patient's foot 137 over foot strap 133 until heel strap 132 rests on the patient's heel (FIG. 16A). The clinician or patient may then pull and flip over the end of foot strap 133 that includes hook/loop patch 138 towards the patient's toes such that hook/loop patch 138 is facing upward as illustrated in FIGS. 17A and 17B. The patient may then lock the proximal end of lower strap 133 using hook/loop patch 134 and hook/loop patch 139*a* disposed on a side of foot rest 83', as illustrated in FIG. 17B. The patient may next flip over the distal end of lower strap 133 such that hook/loop patch 136 locks with hook/loop patch 138, and thereafter, the distal end of lower strap 133 can be locked using hook/loop patch 135 and a hook/loop patch 139*b* disposed on an opposing end of foot rest 83' than hook/loop patch 139*a*, as illustrated in FIG. 17A. At this point, a cross strap 132*a* (FIG. 16A), with a distal end rigidly secured to an inside portion of heel strap 132, is pulled over the patient's foot 137 and locked to the outside portion of heel strap 132 using a hook/loop patch 132*b* disposed on cross strap 132*a* and a hook/loop patch 132*c* disposed on heel strap 132.

It is contemplated that the foot strap 131 and hand strap 130 may be optional and should be used on an as needed basis as determined by the clinician. Each of foot strap 131 and hand strap 130 provide enough strength that each will secure the patient's hands and legs while operating the motorized air walker 900, while being flexible enough that the patient's heel may be lifted during operation of motorized air walker 900. It is also contemplated that if a patient so chooses, he/she can hold grip 103, 103' and operate motorized air walker 900 without any restrictions from hand strap 130 or foot strap 131.

FIGS. 18, 19, 20, and 20A illustrate the operation of harness 800, which can be used with or without a feed tube 251 (gastric tube) and/or a breathing tube 250, or any combination thereof. Strap 201 is disposed on a right side of a patient and includes a female buckle 214*a* disposed on a first end and a male buckle 202*a* disposed on a second, opposing end. Strap 201 is configured to be received within strap hanger 216. Strap hanger 216 is configured to be selectively attached to hook 59 of suspension system 710 using any suitable latching device 216*e*, as discussed in detail hereinabove. Strap 201 is oriented such that female buckle 214*a* is disposed on the backside of the patient, whereas male buckle 202*a* is disposed on the front side of the patient. Harness 800 includes a second strap 200 disposed on a left side of the patient. Strap 200 includes similar components and is utilized in a similar fashion to strap 201, and therefore, in the interest if brevity, details of strap 200 will not be discussed in detail herein.

Figure 20:
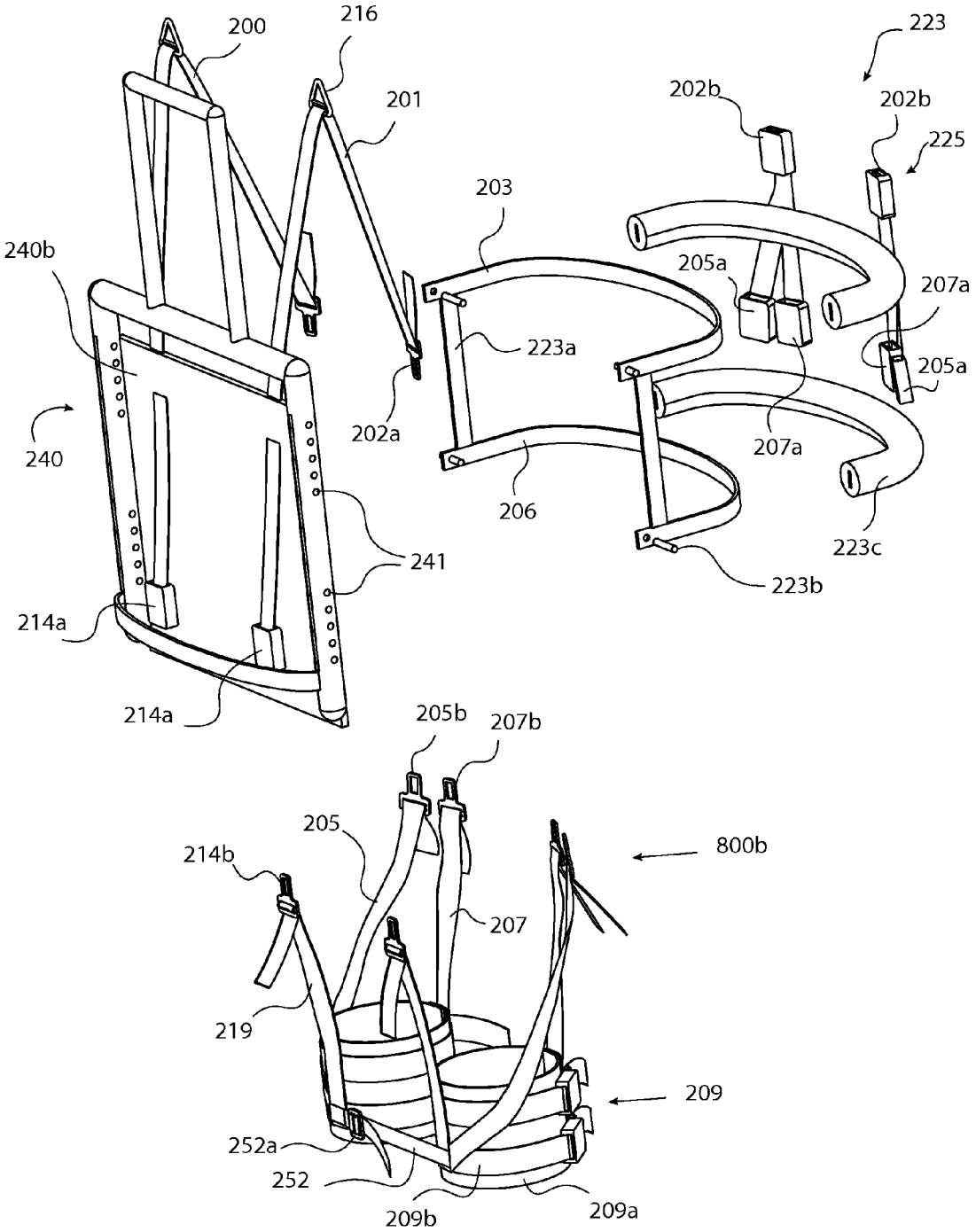
FIG. 20 is a perspective view of the harness of FIG. 18, with parts separated.

As best illustrated in FIG. 20, harness 800 includes cage 223. Cage 223 includes a pair of horizontal arcuate bars 203 and 206 disposed in a stacked orientation. Cage supports 223*a* are interposed between arcuate bars 203 and 206 on either side, thereby forming a hoop configuration. Cage supports 223*a* may be secured to arcuate bars 203, 206 by any suitable means, such as welding, adhesives, or bolted connection. Pins 223*b* are disposed at a rearward position on an outer surface of arcuate bars 203, 206 and extend outwardly therefrom. Pins 223*b* are disposed on both sides of arcuate bars 203, 206 and are configured to be received within a plurality of apertures 241 defined in opposing sides of back support 240. Cage 223 includes a resilient coating 223*c* disposed on arcuate bars 203, 206. Resilient coating 223*c* may be any suitable resilient material, such as foam. A pair of Y-shaped straps 225 is rigidly secured to the front side of the resilient coating 223*c* of cage 223. Each of the pair of Y-shaped straps includes identical components, and therefore, in the interest of brevity, only one Y-shaped strap 225 will be described herein. An upper end of Y-shaped strap 225 includes a female buckle 202*b*, corresponding to male buckle 202*a*. The lower end of Y-shaped strap 225 includes a pair of female buckles 205*a*, 207*a*. It is contemplated that back support 240 may include a suitable resilient material 240*b* disposed thereon, such as foam, in order to minimize patient discomfort. Back support 240 provides a benefit in that back support 240 provides support for head frame 240*a*, thereby providing support for the patient's head (FIG. 18B) during the operation of machine 600. A further benefit is that cage 223 creates a pressure free zone over the patient's abdominal area, thereby inhibiting the application of any stress to feed tube 251 (discussed below).

Figure 19:
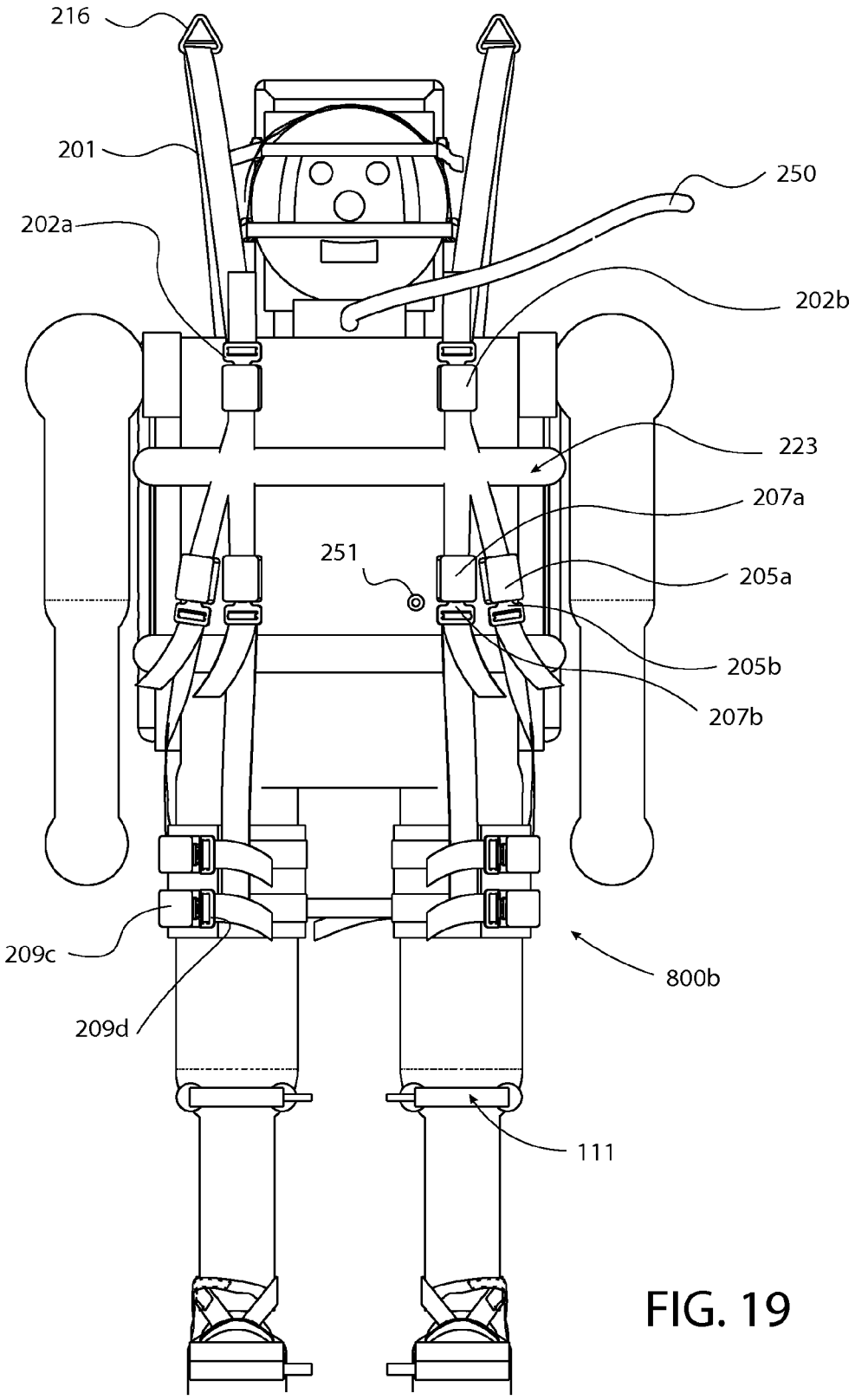
FIG. 19 is a front view of the harness of FIG. 18.
Figure 20A:
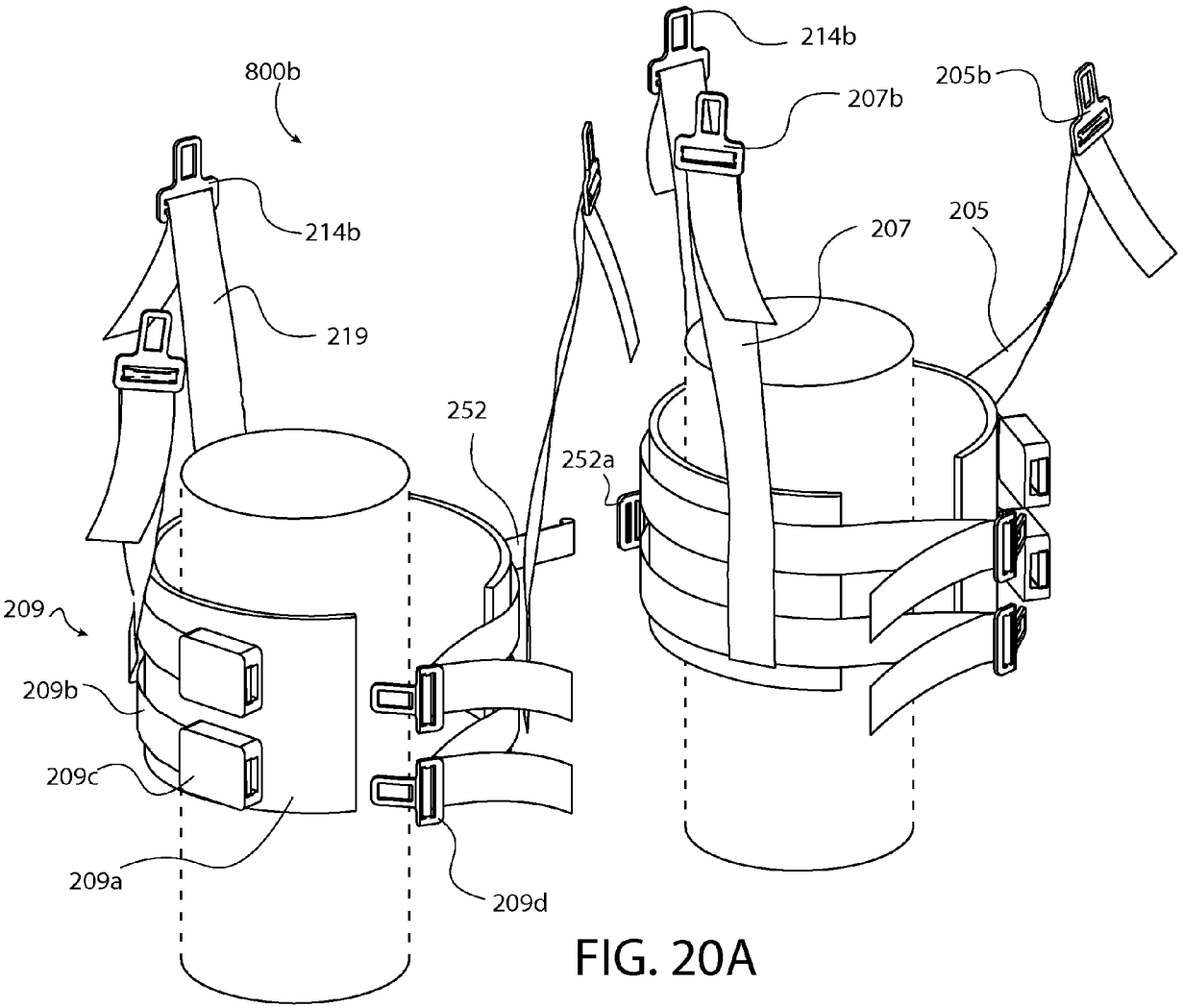
FIG. 20A is a front, perspective view, of a leg harness of the harness of FIG. 20.

Leg harness 800*b* includes a pair of leg cuffs 209. Each of leg cuffs 209 is identical, and therefore, in the interest of brevity, only one leg cuff 209 will be discussed in detail herein. Leg cuff 209 includes a leg pad 209*a*. Although generally shown as having a rectangular shape, leg pad 209*a* may include any suitable shape such as oval or the like. Leg pad 209*a* is constructed of a suitable resilient material, such as foam, in order to minimize patient discomfort. Leg cuff 209 includes a pair of leg pad straps 209*b* attached thereto at one location such first and second ends of leg pad straps 209*b* can move independently of leg pad 209*a*, but cannot become unattached therefrom. Leg pad straps 209*b* include a female buckle 209*c* disposed on a first end and a corresponding male buckle 209*d* disposed on second end (FIGS. 19 and 20A). Leg pad straps 209*b* operate to maintain leg pad 209*a* in a rolled orientation around the patient's leg, thereby preventing the patient's leg from becoming removed from leg harness 800*b*. Leg harness 800*b* includes a rear strap 219 rigidly secured to at least one, as shown two, of leg pad straps 209*b*. A first end of rear strap 219 is rigidly secured to leg pad strap 209*b* at a location at the rear of leg cuff 209 and extends vertically therefrom. A male buckle 214*b* is disposed on a second end of rear strap 219 corresponding to female buckle 214*a*. A front end of the leg pad strap 209*a* that includes rear strap 219 includes a front strap 207 rigidly secured thereto on a first end and extending vertically therefrom. Front strap 207 includes a male buckle 207*b* disposed on an end thereof corresponding to female buckle 207*a* on Y-shaped strap 225. An intermediate strap 205 is rigidly secured to leg strap 209*b* at a similar location to that of rear strap 219. Intermediate strap 205 extends vertically towards the front of leg harness 800*b* and includes a male buckle 205*b* disposed an opposite end thereof corresponding to female buckle 205*a* of Y-shaped strap 225. It is contemplated that any strap utilized in harness 800 may be adjustable, thereby permitting the clinician to easily adjust harness 800 to an individual patient. Each of leg cuffs 209 is secured to each other using lateral strap 252, which is interposed between rear strap 219 and rigidly secured thereto at the joint formed by rear strap 219 and leg pad strap 209*b*. Lateral strap 252 is formed from a suitable resilient material, such as rubber, elastic, or the like, and in operation, inhibits each leg cuff 209 from rotating around the leg while operating due to rotational tension created by strap 205. The tension of lateral strap 252 can be regulated by buckle 252*a*, which may be any suitable buckle capable of adjusting and maintaining tension in lateral strap 252 (FIG. 20).

Figure 18B:
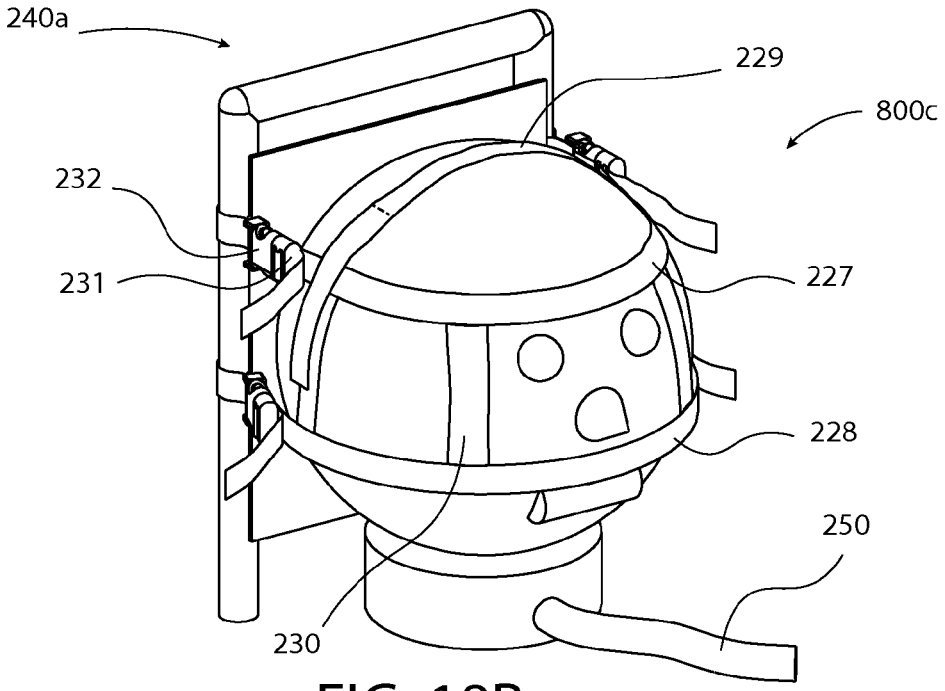
FIG. 18B is a perspective view of the head harness of FIG. 18A, shown secured to a patient's head.

With reference to FIGS. 18-18B, an illustration of head harness 800*c* is provided. Head harness 800*c* includes upper strap 227, lower strap 228, lateral strap 229 and vertical straps 230. Upper and lower straps 227, 228 are oriented in a parallel configuration and each terminates in a male connector 231 on each end. Male connector 231 may be any suitable connector capable of selectively engaging a corresponding female connector 232 and providing adjustment of upper and lower straps 227, 228. Lateral strap 229 is rigidly secured to upper strap 227 on a first end and includes a hook/loop patch 229*a* disposed thereon on a second end. Hook/loop patch 229*a* is configured and/or adapted to engage a corresponding hook/loop patch 227*a* disposed on an opposite side of upper strap 227, thereby preventing head harness 800*c* from sliding in a caudal direction by contacting the crown of the patient's head. Vertical straps 230 are rigidly secured to upper and lower straps 227, 228 on each end and are disposed on opposing sides thereof, as best illustrated in FIG. 18B. Female connectors 232 are disposed on each corner of headboard 240*a*, which extends in a cepahalad direction from back support 240. Headboard 240*a* includes a suitable resilient material disposed thereon, such as foam, in order to minimize patient discomfort. In operation, upper and lower straps 227, 228 are adjusted to accommodate the patient's head. Thereafter, head harness 800*c* may be advanced over the patient's face such that upper strap 227 is disposed over the patient's forehead, whereas lower strap 228 is disposed above the patient's mouth but below the patient's nose. At this point, each of male connectors 231 are inserted within female connectors 232, thereby securing head harness, and thereby the patient's head, to headboard 240*a*. Next, lateral strap 229 is pulled over the crown of the patient's head and secured to upper strap 227 by means of hook/loop patches 227*a*, 229*a*. At this point, each of upper and lower straps 227, 228 may be further adjusted for comfort.

Each strap and buckle used in harness 800 may be any suitable strap and buckle known in the art. In one embodiment, the strap and buckles used in harness 800 are a common automotive type (i.e., a seatbelt). It is further contemplated that each corresponding male and female buckle may be color coordinated (i.e., male buckle 205*b* and female buckle 205*a* can be red, male buckle 207*b* and female buckle 207*a* can be blue, etc.) This configuration aids the clinician in matching up each of the buckles to enable the clinician to quickly and easily strap the patient into harness 800.

In operation, a patient may be transferred to the bed lifer 700 in one room and transported to a separate room where motorized air walker 900 is located. Conversely, the motorized air walker 900 may be transported to the room where the bed lifter 700 is located. It is contemplated that machine 600 may be placed in a patient's household, a clinical setting, a hospital setting, or the like.

Figure 21:
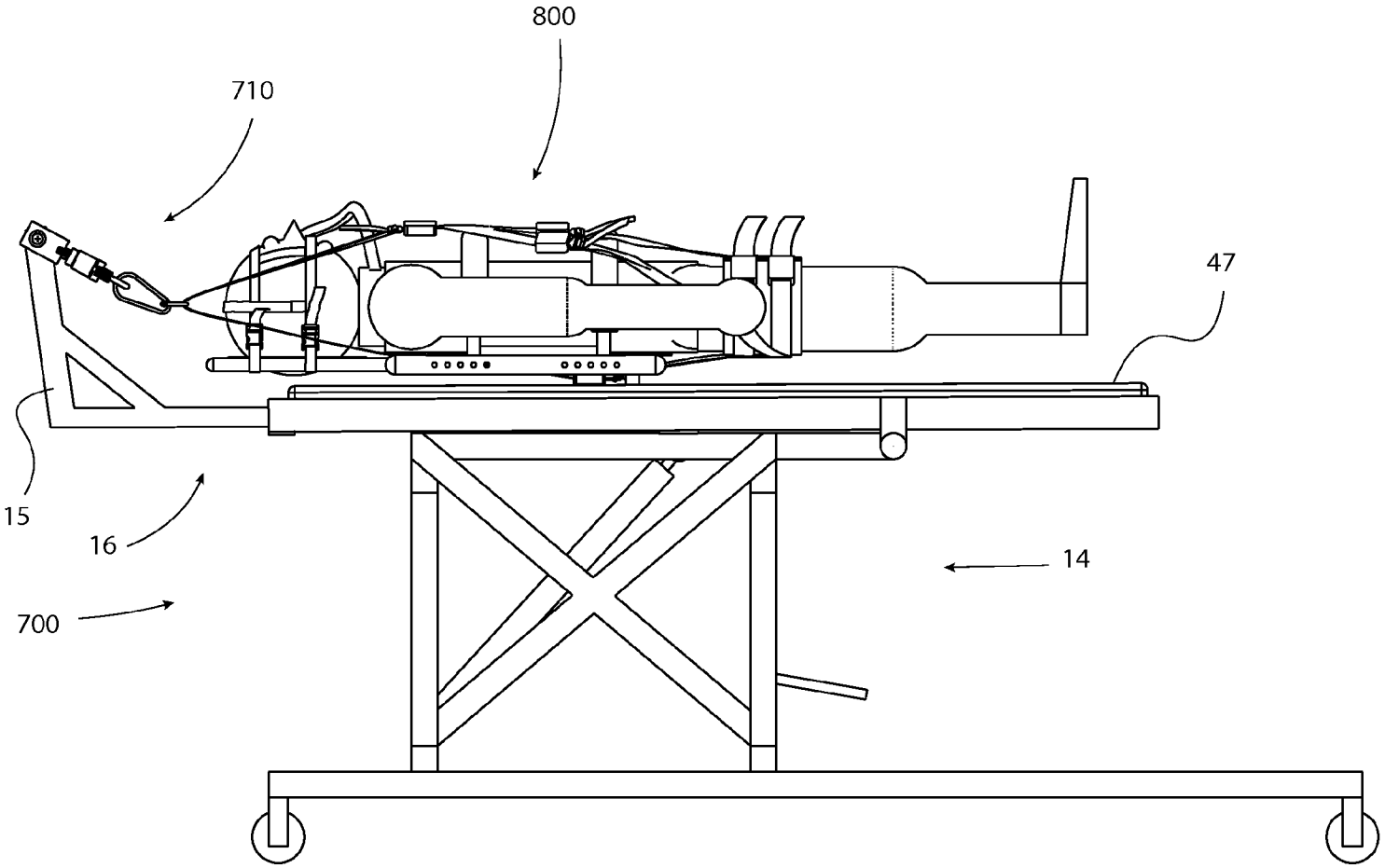
FIG. 21 is an elevation view of the patient rehabilitation system of FIG. 1, with a patient in a supine position.

Initially, as best illustrated in FIG. 21, a patient is in a supine position on bed 47 of bed lifter 700 such that the patient's head is adjacent to arm 15 of wagon 16. It is contemplated that the patient may be prepared with a feed tube 251 and/or a breathing tube 250 before proceeding to the next steps, or during the procedure, as needed. The clinician may next transport the patient and bed lifter 700 to motorized air walker 900, or conversely, the motorized air walker 900 may be transported to the patient and bed lifter 700 such that the motorized air walker 900 is adjacent to the patient's feet. The clinician may next secure harness 800 around the patient's torso, and thereafter adjust harness 800 to accommodate the height of the patient. Once harness 800 has been adjusted, the clinician may secure harness 800 to suspension system 710. At this point, the head harness 800*c* may be secured to the patient's head to support the head before articulating the bed lifter 700 to an inclined position. The clinician may next articulate bed lifter 700 to an inclined position, thereby permitting harness 800 and suspension system 710 to bear the patient's weight and support the patient in a vertical orientation (FIG. 1). Thereafter, the patient may be placed on motorized air walker 900. Depending on the condition of the patient, the clinician may secure the patient to motorized air walker 900 utilizing foot straps 131 and hand straps 130. Once placed on and/or secured to motorized air walker 900, the clinician may adjust motorized air walker 900 to accommodate the height and/or gait of the patient as described in detail hereinabove. The clinician may next operate motorized air walker 900 by utilizing motor 105 to effectuate locomotion, or by allowing the patient to effectuate locomotion utilizing foot supports 83 and 83', and hand grips 103 and 103'. It is contemplated that in the case of a power failure and a failure of the back-up battery system 1000 (described in detail below), bed lifter 700 may be actuated manually using a suitable winch or crank mechanism (not shown). In this manner, the clinician will be able to easily remove the patient from the machine 600 without the assistance of electrical power.

Figure 22:
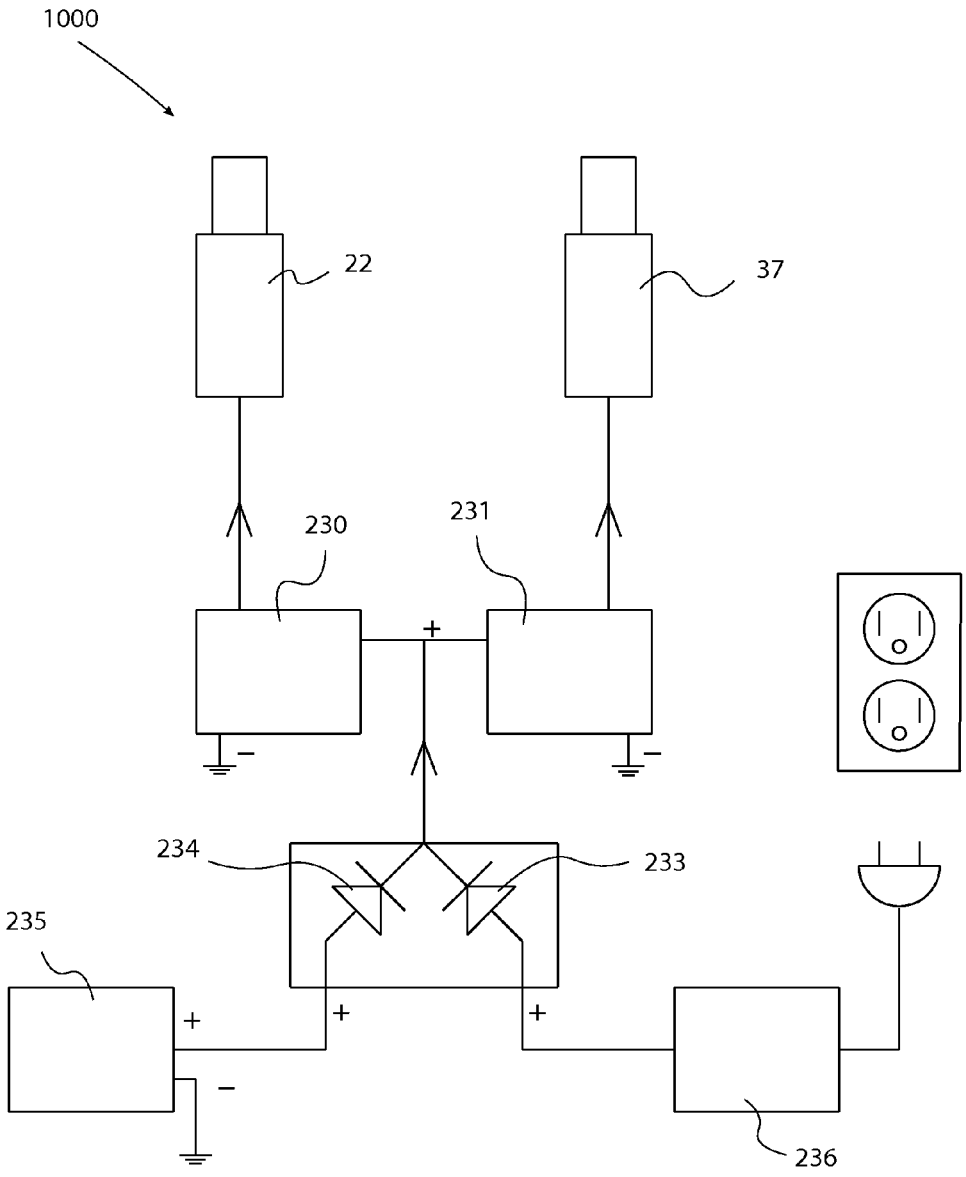
FIG. 22 is a schematic of a battery back-up system of the patient rehabilitation system of FIG. 1.

FIG. 22 illustrates an electrical schematic of a battery back-up system, generally referred to as 1000. Battery back-up system 1000 includes back-up battery 235, main power supply 236, a plurality of rocker switches 230, 231 and a plurality of actuators 37 and 22. During normal operation the actuator 37 is controlled by rocker switch 231, wherein rocker switch 231 controls the power from power supply 236, including a diode 233. In the case where a patient is in an upright position and a power failure occurs, the back-up battery 235 is activated automatically to provide power to rocker 231 through diode 234 in order to power the bed lifter 700 and return the patient to a horizontal position. The same logic applies to actuator 22 and rocker switch 230.

It is contemplated that the plurality of rocker switches 230 and 231 may be replaced by monitor 123 (FIG. 11) and a motion control system such that telescoping actuator 22 and actuator 37 may be controlled therefrom.

Figure 23:
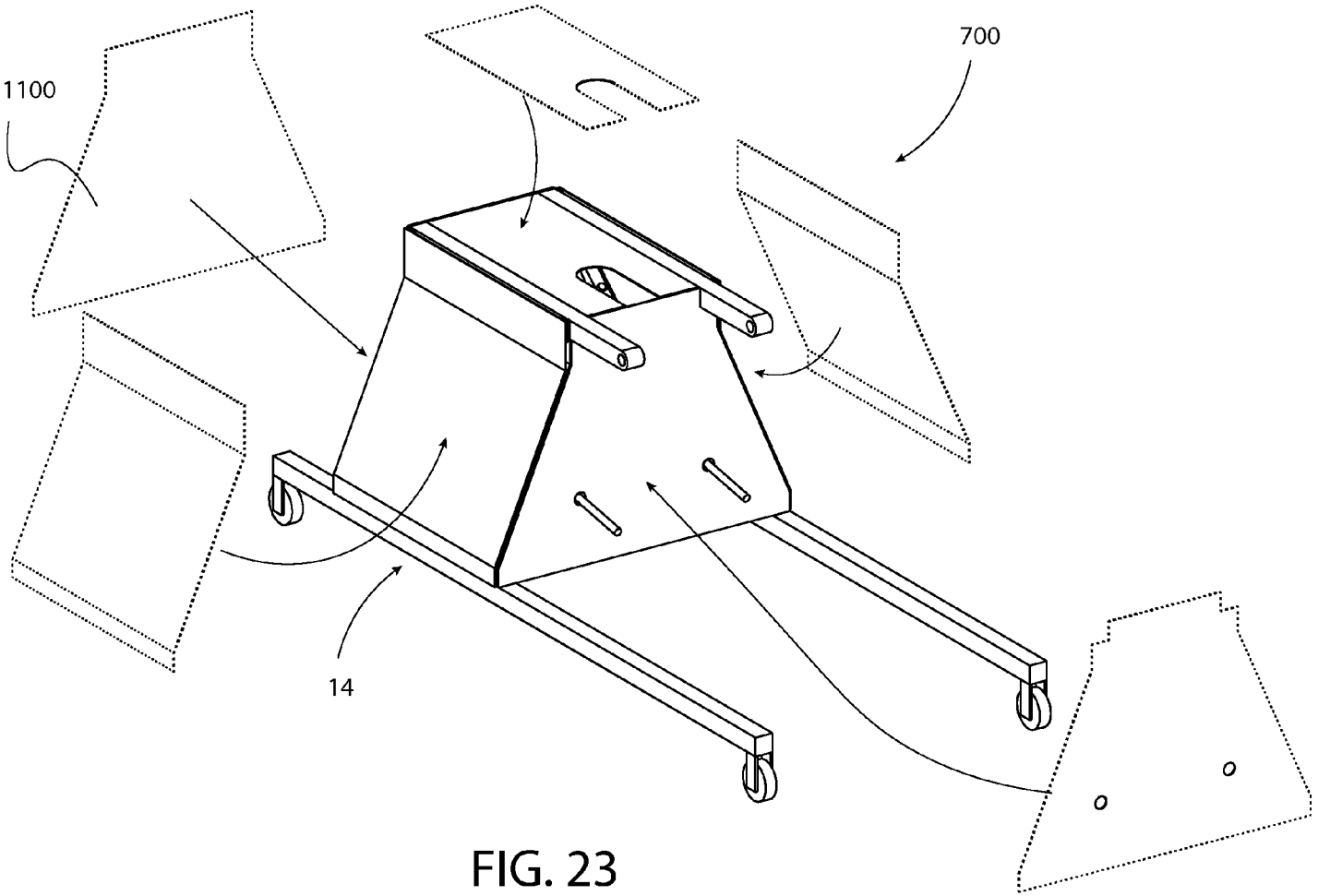
FIG. 23 is a perspective view of a frame of the patient rehabilitation system of FIG. 1, shown with an enclosure.
Figure 24:
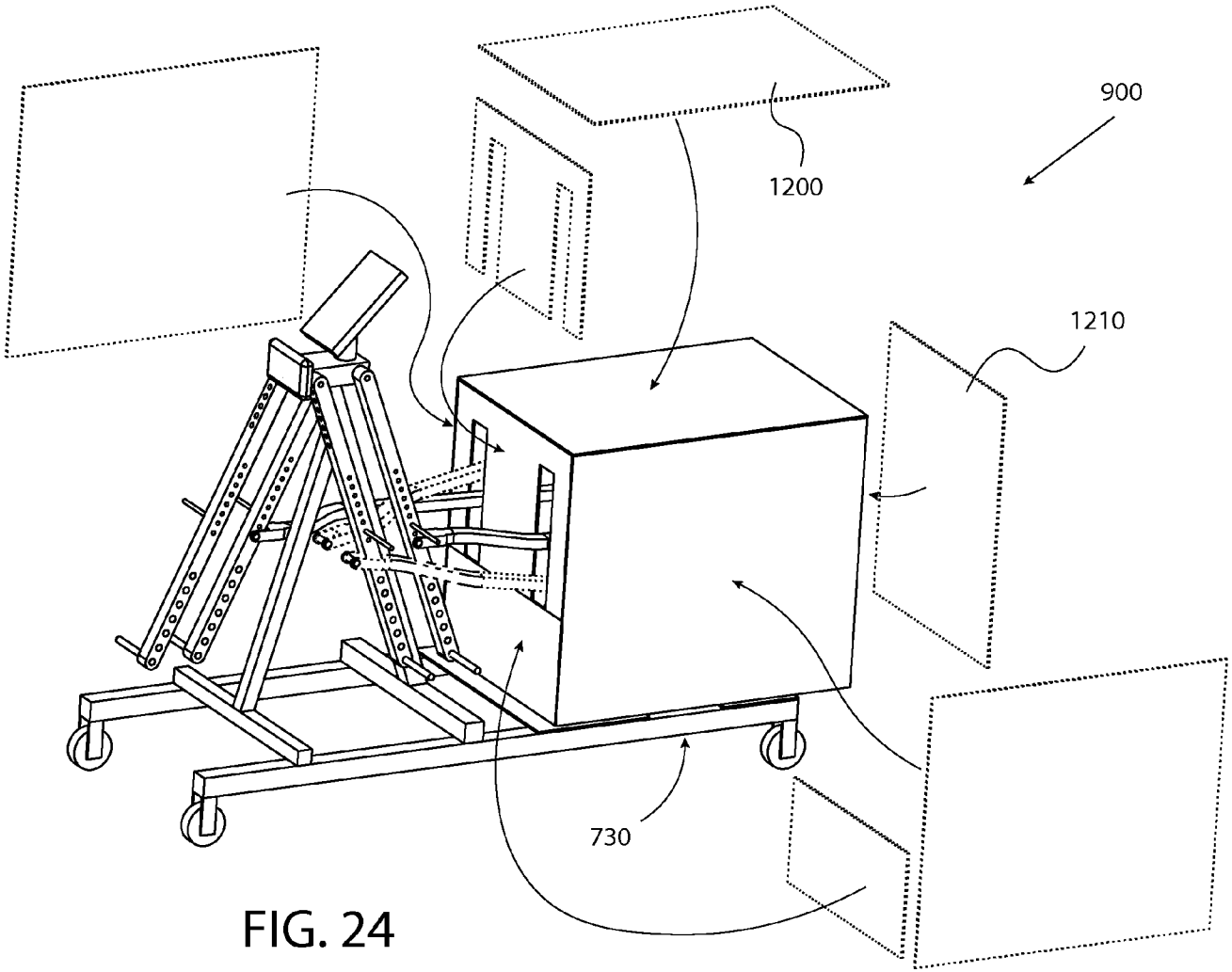
FIG. 24 is a perspective view of the motorized air walker of FIG. 7, shown with an enclosure.

With reference to FIG. 23, it is contemplated that frame 14 of bed lifter 700 may be enclosed via a plurality of panels 1100. Each of panels 1100 may be constructed of any rigid material suitable for sue in a clinical setting, such as stainless steel, polypropylene, or the like. Similarly, as illustrated in FIG. 24, reciprocator 730 of motorized air walker 900 may be enclosed via a plurality of panels 1200, thereby preventing injury from contact with the moving parts of reciprocator 730.

It will be understood that various modifications may be made to the embodiments of the presently disclosed screw insertion instrument. Therefore, the above description should not be construed as limiting, but merely as exemplifications of embodiments. Those skilled in the art will envision other modifications within the scope and spirit of the present disclosure.

What is claimed is:

1. A system for patient rehabilitation, comprising:
an articulating bed, including:
a first movable frame;
a bed including a first and second end, wherein the bed is rotatably supported by the first movable frame at a first end, wherein the bed is configured to be selectively articulated to an inclined position; and
a suspension system, wherein the suspension system is disposed within the bed, wherein the suspension system includes a frame including proximal and distal ends, wherein the frame is translatably supported by the bed, wherein the frame includes an arm extending from the first end of the bed, wherein the suspension system is selectively adjustable along a longitudinal axis between the first and second ends of the bed; and
a walker, including:
a second movable frame;
a pair of legs including an upper and lower end, wherein each of the pair of legs is rotatably supported by the second movable frame, wherein each of the pair of legs includes a foot support on the lower end thereof, wherein each of the pair of legs includes a gripping portion for a patient's hand on the upper end thereof;
a reciprocator, including:
a motor, wherein the motor is rigidly secured to the second movable frame, wherein the motor includes a sprocket, wherein the sprocket is in mechanical cooperation with the motor;
a reciprocator frame, wherein the reciprocator frame is rigidly secured to the second movable frame; and
a flywheel rotatably supported by the reciprocator frame, wherein the flywheel is in operative communication with the sprocket, wherein the flywheel is in operative communication with at least one of the pair of legs.

2. The system of claim 1, further comprising:
a harness, including a plurality of straps for securing the torso, legs, head, hands, arms, and feet of a patient, wherein at least one of the plurality of straps is selectively engageable with the suspension system of the articulating bed, wherein at least one of the plurality of straps is selectively adjustable to accommodate a variety of patient sizes.

3. The system of claim 1, wherein the bed defines a plane, wherein the bed is articulatable from a first orientation wherein the plane of the bed is parallel to a floor supporting the system, and second inclined orientation angled with respect to the first orientation.

4. The system of claim 3, wherein the second inclined orientation is orthogonal to the first orientation.

5. The system of claim 4, wherein the suspension system includes a harness supported by the arm.

6. The system of claim 1, wherein the second movable frame includes a knee support disposed on each of the pair of legs, the knee support configured to support the patient's knee, wherein the knee support is adjustable to accommodate a variety of patient sizes.

7. The system of claim 1, further comprising an actuator operably connected to the frame of the suspension system, wherein actuation of the actuator translates the frame of the suspension system.

8. The system of claim 7, wherein the actuator is selected from the group consisting of a hydraulic actuator, a pneumatic actuator, and an electric actuator.

9. The system of claim 1, wherein the reciprocator further includes a pair of adjustment bars, wherein the pair of adjustment bars are rigidly secured to a first side and a second side of the flywheel, wherein the pair of adjustment bars radially extend from a center point of the flywheel in opposing directions, wherein the adjustment bars include a plurality of holes defined therethrough extending along a longitudinal axis of each of the pair of adjustment bars.

10. The system of claim 9, further including a pair of pivot blocks, wherein the pivot blocks are configured and dimensioned to advance over each of the pair of adjustment bars, wherein the pivot blocks are selectively enageable with one of the plurality of holes of the adjustment bars, wherein each of the pair of pivot blocks includes an axle extending normally therefrom.

11. The system of claim 10, further including a pair of control members having proximal and distal ends, wherein the proximal end of each of the pair of control members is rotatably supported by one of the pair of legs of the walker, wherein the distal end is rotatably supported by the axle of the pivot block.

12. The system of claim 11, wherein a height of the gripping portion of the pair of legs is selectively adjustable.

13. The system of claim 1, wherein the motor includes a speed reduction gearbox.

14. The system of claim 1, further including a drive transmitting device to transmit the rotation of the sprocket to the flywheel.

15. The system of claim 14, wherein the drive transmitting device is one of a chain or a belt.

16. A system for patient rehabilitation, comprising:
an articulating bed, including:
a first movable frame;
a bed including a first and second end, wherein the bed is rotatably supported by the first movable frame at a first end, wherein the bed is configured to be selectively articulated to an inclined position; and
a suspension system, wherein the suspension system is disposed within the bed, wherein the suspension system includes a frame including proximal and distal ends, wherein the frame is translatably supported by the bed, wherein the frame includes an arm extending from the proximal end thereof, wherein the arm is configured to support a harness, wherein the suspension system is selectively adjustable along a longitudinal axis defined by the first and second ends of the bed;

a walker, including:

a second movable frame;

a pair of legs including an upper and lower end, wherein each of the pair of legs is rotatably supported by the second movable frame, wherein each of the pair of legs includes a foot support on the lower end thereof, wherein each of the pair of legs includes a gripping portion for a patient's hand on the upper end thereof;

a reciprocator, including:

a motor, wherein the motor is rigidly secured to the second movable frame, wherein the motor includes a sprocket, wherein the sprocket is in mechanical cooperation with the motor;

a reciprocator frame, wherein the reciprocator frame is rigidly secured to the second movable frame; and a flywheel rotatably supported by the reciprocator frame, wherein the flywheel is in operative communication with the sprocket, wherein the flywheel is in operative communication with at least one of the pair of legs; and a harness, including a plurality of straps for securing the torso, legs, head, hands, arms, and feet of a patient, wherein at least one of the plurality of straps is selectively engageable with the suspension system of the articulating bed, wherein at least one of the plurality of straps is selectively adjustable to accommodate a variety of patient sizes.

17. The system of claim 16, wherein the articulating bed includes an actuator for articulation.

18. The system of claim 17, wherein the actuator is selected from the group consisting of a hydraulic actuator, a pneumatic actuator, and an electric actuator.

19. The system of claim 17, wherein the foot support is adjustable to accommodate a variety of patient sizes.

* * * * *